US012467451B2

(12) United States Patent
Mannewitz et al.

(10) Patent No.: US 12,467,451 B2
(45) Date of Patent: Nov. 11, 2025

(54) REFRIGERANT COMPRESSOR

(71) Applicant: BITZER Kuehlmaschinenbau GmbH, Sindelfingen (DE)

(72) Inventors: Jens Mannewitz, Schkeuditz (DE); Tobias Fuhrer, Rottenburg (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 393 days.

(21) Appl. No.: 17/883,806

(22) Filed: Aug. 9, 2022

(65) Prior Publication Data

US 2022/0381236 A1 Dec. 1, 2022

Related U.S. Application Data

(63) Continuation of application No. PCT/EP2021/053211, filed on Feb. 10, 2021.

(30) Foreign Application Priority Data

Feb. 14, 2020 (DE) ..... 102020103975.1

(51) Int. Cl.
*F04B 49/06* (2006.01)
*F04B 27/00* (2006.01)
(Continued)

(52) U.S. Cl.
CPC ..... *F04B 49/06* (2013.01); *F04B 27/005* (2013.01); *F04B 35/04* (2013.01); *F04B 49/02* (2013.01); *F25B 31/023* (2013.01)

(58) Field of Classification Search
CPC ..... F04B 49/06; F04B 27/005; F04B 35/04; F04B 49/02; F25B 31/023
(Continued)

(56) References Cited

U.S. PATENT DOCUMENTS 4,149,827 A * 4/1979 Hofmann, Jr. ..... F04C 28/24 417/12
5,282,723 A * 2/1994 Bellomo ..... F04B 39/1073 417/45

(Continued)

FOREIGN PATENT DOCUMENTS

DE 19918161 A1 11/2000
DE 102013203268 A1 8/2014

(Continued)

*Primary Examiner* — Mark A Laurenzi
*Assistant Examiner* — Benjamin Doyle
(74) *Attorney, Agent, or Firm* — Reinhart Boerner Van Deuren P.C.

(57) ABSTRACT

Refrigerant compressor for refrigeration systems, comprising an electric motor, at least two cylinder banks and a mechanical performance control unit for activating and deactivating at least one of the cylinder banks in order to activate or deactivate its refrigerant output, wherein, for the purpose of operation in partial performance conditions, the refrigerant compressor is operable in at least two different operating modes, of which each provides an activation or deactivation of the cylinder banks that is different from the other operating modes, wherein associated with the refrigerant compressor is a frequency converter for controlling the speed of the electric motor, wherein associated with the refrigerant compressor is an operating condition controller that, in accordance with a performance request signal supplied to it for operation of the refrigerant compressor in the partial performance condition corresponding to this performance request signal, operates the refrigerant compressor in an operating mode that is selected from at least two different operating modes and at a speed adapted to the selected operating mode, for the purpose of achieving this partial performance condition.

23 Claims, 14 Drawing Sheets

(51) Int. Cl.
*F04B 35/04* (2006.01)
*F04B 49/02* (2006.01)
*F25B 31/02* (2006.01)

(58) Field of Classification Search
USPC ..... 417/45
See application file for complete search history.

(56) References Cited

U.S. PATENT DOCUMENTS 6,037,725 A * 3/2000 Tolbert, Jr. ..... B60H 1/00428 307/73
6,206,652 B1 * 3/2001 Caillat ..... F04C 27/005 417/298
8,418,489 B2 * 4/2013 Okamoto ..... F25B 13/00 62/204
2001/0011463 A1 8/2001 Pollrich et al.
2003/0070441 A1 * 4/2003 Moon ..... F04C 23/008 62/210
2004/0093881 A1 * 5/2004 Kim ..... F24F 11/86 62/228.1
2006/0218959 A1 * 10/2006 Sandkoetter ..... F04B 49/225 417/269
2006/0288719 A1 * 12/2006 Shapiro ..... F04B 35/045 62/228.3
2007/0251245 A1 * 11/2007 Sakitani ..... F04C 18/322 62/6
2008/0011014 A1 * 1/2008 Renz ..... F25B 41/20 62/510
2010/0329894 A1 * 12/2010 Tolbert, Jr. ..... F04B 39/08 417/279
2012/0210736 A1 * 8/2012 Rockenfeller ..... F25B 7/00 62/115
2013/0121845 A1 * 5/2013 Giewont ..... H02P 21/34 417/45
2013/0213065 A1 * 8/2013 Gomes ..... F25B 49/022 62/216
2015/0361972 A1 12/2015 Barth et al.
2016/0153442 A1 * 6/2016 Lim ..... F04B 49/20 417/45
2017/0218944 A1 * 8/2017 Schmidt ..... F04B 51/00
2018/0128254 A1 * 5/2018 Lifson ..... F25B 1/10
2018/0356139 A1 * 12/2018 Johnson ..... F04B 49/20
2019/0234392 A1 * 8/2019 Grosse-Kracht ..... F04B 53/007
2019/0277276 A1 * 9/2019 Cain ..... F04B 49/06
2021/0010468 A1 * 1/2021 Kim ..... F04B 49/20
2021/0246892 A1 * 8/2021 Mitchell ..... F04B 39/066

FOREIGN PATENT DOCUMENTS

EP 1710435 A1 10/2006
WO WO 2018/065071 A1 4/2018

* cited by examiner

REFRIGERANT COMPRESSOR

This application is a continuation of international application number PCT/EP2021/053211 filed on 10 Feb. 2021 and claims the benefit of German application number 10 2020 103 975.1 filed on 14 Feb. 2020.

The present disclosure relates to the subject matter disclosed in international application number PCT/EP2021/053211 of 10 Feb. 2021 and German application number 10 2020 103 975.1 of 14 Feb. 2020, which are incorporated herein by reference in their entirety and for all purposes.

BACKGROUND OF THE INVENTION

The invention relates to a refrigerant compressor for refrigeration systems, comprising an electric motor, at least two cylinder banks, each of which has at least one cylinder unit having a respective cylinder housing and a reciprocating-movement piston driven by the electric motor, and a cylinder head that is associated with each cylinder bank and has an inlet chamber, through which an inlet stream flows, and an outlet chamber, through which an outlet stream passes, and a mechanical performance control unit for activating and deactivating the respective cylinder bank in order to activate or deactivate its refrigerant output.

Refrigerant compressors of this kind are known from the prior art, for example WO 2018/065071 A1.

In these refrigerant compressors there arises the problem of operating them as optimally as possible.

In accordance with an embodiment of the invention, provision is made in the case of a refrigerant compressor of the type mentioned in the introduction that, for the purpose of operation in partial performance conditions, the refrigerant compressor is operable in at least two different operating modes, of which each provides an activation or deactivation of the cylinder banks that is different from the other operating modes, that the refrigerant compressor comprises a frequency converter for controlling the speed of the electric motor, that associated with the refrigerant compressor is an operating condition controller that, in accordance with a performance request signal supplied to it for operation of the refrigerant compressor in the partial performance condition corresponding to this performance request signal, operates the refrigerant compressor in an operating mode that is selected from the at least two different operating modes and at a speed of the electric motor adapted to the selected operating mode, for the purpose of achieving this partial performance condition.

SUMMARY OF THE INVENTION

The advantage of this provision according to the invention can be seen in the fact that, for operation of the refrigerant compressor in the partial performance conditions, at least two, preferably more, operating modes are available by which it is possible for the operating condition controller to operate the refrigerant compressor in optimised manner, wherein in each operating mode a multiplicity of partial performance conditions can be achieved by varying the speed, in particular by continuously variable variation of the speed, of the electric motor between a minimum speed and a maximum speed.

In particular, this makes it possible to achieve the maximum partial performance condition and the minimum partial performance condition respectively in the operating mode with the greatest refrigerant input and in the operating mode with the lowest refrigerant output, by varying the speed between the maximum speed and the minimum speed.

Thus, as a result of combining selection of an operating mode with the in particular continuously variable selection of the speed, a multiplicity of partial performance conditions is available.

The solution according to the invention is particularly advantageous if $CO_2$ is used as the refrigerant.

Of the various operating modes, it is preferably provided for the operating condition controller to operate the refrigerant compressor in a first operating mode, with activation of all the cylinder banks and with adaptation of the speed to the first operating mode, wherein this first operating mode is usable in particular for operating conditions in a partial performance range close to maximum performance.

Further, it is preferably also provided for the operating condition controller to operate the refrigerant compressor in at least one further operating mode, with deactivation of at least one of the cylinder banks and with activation of at least one of the cylinder banks and with adaptation of the speed of the electric motor to this operating mode.

This means that, in this case, for partial performance ranges that are particularly suitable for achieving a performance request signal with medium or low performance, uses an operating mode in which only some of the cylinder banks are active.

It is particularly favourable in the solution according to the invention if, in the case of partial performance conditions that are achievable by a plurality of the operating modes, the operating condition controller selects the operating mode that results in the highest quality grade or Coefficient of Performance (COP) value or the lowest electrical power consumption of the electric motor in this partial performance condition.

This selection may be achieved for example in that the operating condition controller has stored, for each of the operating modes and each of the partial performance conditions, information on the quality grade or the COP value or the electrical power consumption of the electric motor.

As an alternative, an advantageous solution provides for the operating condition controller to determine, for the operating modes that are in each case possible for achieving a partial performance condition, the quality grade or the COP value or the electrical power consumption of the electric motor, and to select the operating mode by comparing the determined quality grades or COP values or electrical power consumption.

In particular in this case, it is provided for the controller to have stored data for the purpose of determining the quality grade or COP value for each operating mode, or to have stored data during operation, in particular by detecting the electrical power consumption of the electric motor, and to use it in future.

Moreover, it is likewise advantageous if the quality grade or COP value or electrical power consumption is determined by the operating condition controller by the detection of a suction pressure and/or of the high pressure at the refrigerant compressor, since these parameters affect the quality grade of the respective operating mode in the respective partial performance condition.

Further, it is preferably provided for the controller to make use of the refrigerant, the partial performance condition, the power consumption and/or the speed of the electric motor in order to determine the quality grade or COP value or electrical power consumption.

Whether the quality grade or COP value or electrical power consumption is determined by the controller reading off already stored quality grades or COP values or electrical power consumption depending on the suction pressure and/or high pressure and/or refrigerant and/or partial performance condition and/or power consumption, or whether it determines them by calculation, depends in particular on the configuration of the operating condition controller and the complexity and precision of determining the quality grade or the COP value or the electrical power consumption.

For example, for the purpose of simplifying the procedure, it is possible, in order to determine the quality grade or COP value of the operating modes, for the partial performance conditions that are to be achieved to be divided into partial performance conditions that are above a boundary value and those below a boundary value, and in the case of partial performance conditions above the boundary value in operating modes that require a relatively high speed of the electric motor to make the assumption of a relatively high quality grade or COP value or a relatively low electrical power consumption and thus to select these, and in the case of partial performance conditions below a boundary value in operating modes that require a relatively low speed of the electric motor to make the assumption of a relatively high quality grade or COP value or a relatively low electrical power consumption and thus to select these.

Likewise, the most diverse solutions are conceivable as regards the manner of deactivating and activating the cylinder banks.

Thus, in an advantageous solution, it is provided, in the case of a first type of operating modes, for the operating condition controller to permanently maintain the respective operating mode with a fixedly predetermined deactivation and activation of the cylinder banks in order to achieve the partial performance condition that is required by the performance request signal.

This means that with the first type of operating modes the activation and deactivation of the cylinder banks is permanently maintained when achieving a partial performance condition and does not change.

However, a further advantageous solution provides, in at least one operating mode corresponding to a second type of operating modes, for the operating condition controller to operate by clocked deactivation and activation at least one of the cylinder banks at defined switching intervals, wherein in this operating mode in particular the proportion of time for which at least one of the cylinder banks is deactivated and activated at the switching intervals is constant when the respective partial performance condition is achieved.

This means that, with an operating mode of the second type, during a switching interval deactivation is performed over a certain time period, and activation of the cylinder bank is performed over the respectively remaining time period, and the operating mode keeps this proportion of deactivation and activation over time constant while the respective partial performance condition is being carried out.

In the context of explanation of the solution according to the invention thus far, more detailed statements have not been made as to how activation and deactivation of each cylinder bank is to be performed.

Thus, an advantageous solution provides for activation and deactivation of each cylinder bank to be performed with the aid of a mechanical performance control unit that is controlled by the operating condition controller.

This means that the operating condition controller controls the mechanical performance control unit of each of the cylinder banks.

In this context, the mechanical performance control unit may in principle be arranged at any location in the refrigerant compressor.

It is particularly favourable if the mechanical performance control unit is associated with a cylinder head of the cylinder bank.

Moreover, it is advantageously provided for the mechanical performance control unit to control an inlet stream into the inlet chamber of the cylinder head for the purpose of activating or deactivating the respective cylinder bank.

This means that the performance control unit interrupts the inlet stream into the inlet chamber and hence deactivates the respective cylinder bank, or vice versa.

Another advantageous solution provides for the performance control unit to connect the outlet chamber to the inlet chamber in the cylinder head for the purpose of activating or deactivating the respective cylinder bank.

This means that in this case the performance control unit short-circuits the outlet chamber and the inlet chamber such that it is possible to drive the cylinder bank without fluctuations in torque—a solution which is particularly suitable where $CO_2$ is the refrigerant.

It is provided for example for the operating condition controller to be able to be a controller that is separate from the frequency converter.

This means that, for example if the frequency converter is integrated into the refrigerant compressor, the operating condition controller is arranged separately, for example on the refrigerant compressor or independently thereof.

As an alternative, however, it is also possible for the operating condition controller to be arranged in a housing that receives the frequency converter and, in the simplest case, is arranged on or in the compressor housing.

An advantageous embodiment of the refrigerant compressor provides for the cylinder banks to work in a parallel operation.

A favourable performance yield is achievable in particular if the refrigerant compressor has at least two cylinder units per cylinder bank.

The number of operating modes can be maximised if the refrigerant compressor has more than two cylinder banks.

Moreover, the invention relates to a refrigeration system, comprising a refrigerant compressor, a heat exchanger on the high-pressure side, an expansion member, and a heat exchanger on the low-pressure side.

According to the invention, for the purpose of optimising operation of a refrigeration system of this kind, it is provided for the refrigerant compressor to take a form according to one of the preceding embodiments.

Further, it is preferably provided for the refrigeration system to have a system controller that generates the performance request signal, for example depending on the material that is to be refrigerated.

In this case, it is also possible for the operating condition controller to be arranged in a housing of the system controller.

Thus, the above description of solutions according to the invention comprises in particular the different combinations of features that are defined by the consecutively numbered embodiments below:

1. A refrigerant compressor (12) for refrigeration systems (10), comprising an electric motor (60), at least two cylinder banks (42), each of which has at least one cylinder unit (44) having in each case at least one cylinder housing (46) and at least one reciprocating-movement piston (48) driven by the electric motor (60), and a cylinder head (58) that is associated with each cylinder bank (42) and has an inlet chamber (72, 162), through which an inlet stream (74) flows, and an outlet chamber (88, 164), through which an outlet stream (86) flows, and a mechanical performance control unit (70) for activating and deactivating at least one of the cylinder banks (42) in order to activate or deactivate its refrigerant output, wherein, for the purpose of operation in partial performance conditions, the refrigerant compressor (12) is operable in at least two different operating modes, of which each provides an activation or deactivation of the cylinder banks (42) that is different from the other operating modes (B), in that associated with the refrigerant compressor (12) is a frequency converter (132) for controlling the speed of the electric motor (60), in that associated with the refrigerant compressor (12) is an operating condition controller (130) that, in accordance with a performance request signal (LA) supplied to it for operation of the refrigerant compressor (12) in the partial performance condition corresponding to this performance request signal (LA), operates the refrigerant compressor (12) in an operating mode (B) that is selected from at least two different operating modes (B) and at a speed of the electric motor (60) adapted to the selected operating mode (B), for the purpose of achieving this partial performance condition.

2. A refrigerant compressor according to embodiment 1, wherein the operating condition controller (132) operates the refrigerant compressor (12) in a first operating mode (B1), with activation of all the cylinder banks (42) and with adaptation of the speed of the electric motor (60) to the first operating mode (B1).

3. A refrigerant compressor according to embodiment 1 or 2, wherein the operating condition controller operates the refrigerant compressor (12) in at least one further operating mode (B), with deactivation of at least one of the cylinder banks (42) and with activation of at least one of the cylinder banks (42) and with adaptation of the speed of the electric motor (60) to this operating mode (B).

4. A refrigerant compressor according to one of the preceding embodiments, wherein, in the case of partial performance conditions that are achievable by a plurality of the operating modes (B), the operating condition controller (130) selects the operating mode (B) that results in the highest quality grade or COP value or the lowest electrical power consumption of the electric motor (60) in this partial performance condition.

5. A refrigerant compressor according to embodiment 4, wherein the operating condition controller (130) determines, for the operating modes (B) that are in each case possible for achieving a partial performance condition, the quality grade or the COP value or the electrical power consumption of the electric motor (60), and selects the operating mode (B) by comparing the determined quality grades or COP values or electrical power consumption.

6. A refrigerant compressor according to embodiment 4 or 5, wherein the operating condition controller (130) has stored data for the purpose of determining the quality grade or COP value or electrical power consumption for each operating mode (B).

7. A refrigerant compressor according to one of embodiments 4 to 6, wherein the quality grade or COP value or electrical power consumption is determined by the operating condition controller (130) by the detection of the suction pressure (PS) and/or of the high pressure (PH) at the refrigerant compressor (12).

8. A refrigerant compressor according to one of embodiments 4 to 7, wherein the operating condition controller (130) makes use of the refrigerant, the partial performance condition, the power consumption and/or the speed of the electric motor (60) in order to determine the quality grade or COP value or electrical power consumption.

9. A refrigerant compressor according to one of the preceding embodiments, wherein, in order to determine the quality grade or COP value of the operating modes, the partial performance conditions that are to be achieved are divided into partial performance conditions that are above a boundary value (PHG) and those below a boundary value (PHG), and in that in the case of partial performance conditions above the boundary value (PHG) in operating modes (B) that require a relatively high speed of the electric motor (60) the assumption is made of a relatively high quality grade or COP value or a relatively low electrical power consumption and thus these are selected, and in the case of partial performance conditions below the boundary value (PHG) in operating modes (B) that require a relatively low speed of the electric motor (60) the assumption is made of a relatively high quality grade or COP value or a low electrical power consumption and thus these are selected.

10. A refrigerant compressor according to one of the preceding embodiments, wherein, in the case of a first type of operating modes, the operating condition controller (130) permanently maintains the respective operating mode (B) with a fixedly predetermined deactivation and activation of the cylinder banks (42) in order to achieve the partial performance condition that is required by the performance request signal (LA).

11. A refrigerant compressor according to one of the preceding embodiments, wherein, in at least one operating mode (B) corresponding to a second type of operating modes, the operating condition controller (130) operates the refrigerant compressor (12) by clocked deactivation and activation at least one of the cylinder banks (42) at defined switching intervals (SI), wherein in this operating mode (B) in particular the proportion of time for which at least one of the cylinder banks (42) is deactivated and activated at the switching intervals (SI) is constant when the respective partial performance condition is achieved.

12. A refrigerant compressor according to one of the preceding embodiments, wherein activation and deactivation of each cylinder bank (42) is performed with the aid of a mechanical performance control unit (70) that is controlled by the operating condition controller (130).

13. A refrigerant compressor according to embodiment 12, wherein the mechanical performance control unit (70) is associated with a cylinder head (58) of the cylinder bank (42).

14. A refrigerant compressor according to embodiment 12 or 13, wherein the mechanical performance control unit (70) controls an inlet stream (74) into the inlet chamber (72) of the cylinder head (58) for the purpose of activating or deactivating the respective cylinder bank (42).

15. A refrigerant compressor according to one of embodiments 1 to 14, wherein the performance control unit (70) connects the outlet chamber (164) to the inlet chamber (162) in the cylinder head (58) for the purpose of activating or deactivating the respective cylinder bank (42').

16. A refrigerant compressor according to one of the preceding embodiments, wherein the operating condition controller (130) is an operating condition controller that is separate from the frequency converter (132).

17. A refrigerant compressor according to one of embodiments 1 to 16, wherein the operating condition controller (130) is arranged in a housing (40) that receives the frequency converter (132).

18. A refrigerant compressor according to one of the preceding embodiments, wherein the cylinder banks (42) of the refrigerant compressor (12) work in a parallel operation.

19. A refrigerant compressor according to one of the preceding embodiments, wherein the refrigerant compressor (12) has at least two cylinder units (44) per cylinder bank (42).

20. A refrigerant compressor according to one of the preceding embodiments, wherein the refrigerant compressor (12) has more than two cylinder banks (42).

21. A refrigeration system, comprising a refrigerant compressor (12), a heat exchanger (18) on the high-pressure side, an expansion member (30), and a heat exchanger (32) on the low-pressure side, wherein the refrigerant compressor (12) takes a form according to one of the preceding embodiments.

22. A refrigeration system according to embodiment 21, wherein the refrigeration system (10) has a system controller (138) that generates the performance request signal (LA).

23. A refrigeration system according to embodiment 22, wherein the operating condition controller (130) is arranged in a housing of the system controller (138).

Further features and advantages of the invention form the subject matter of the description below and the representation in the drawing of some exemplary embodiments.

DETAILED DESCRIPTION OF THE INVENTION

Figure 1:
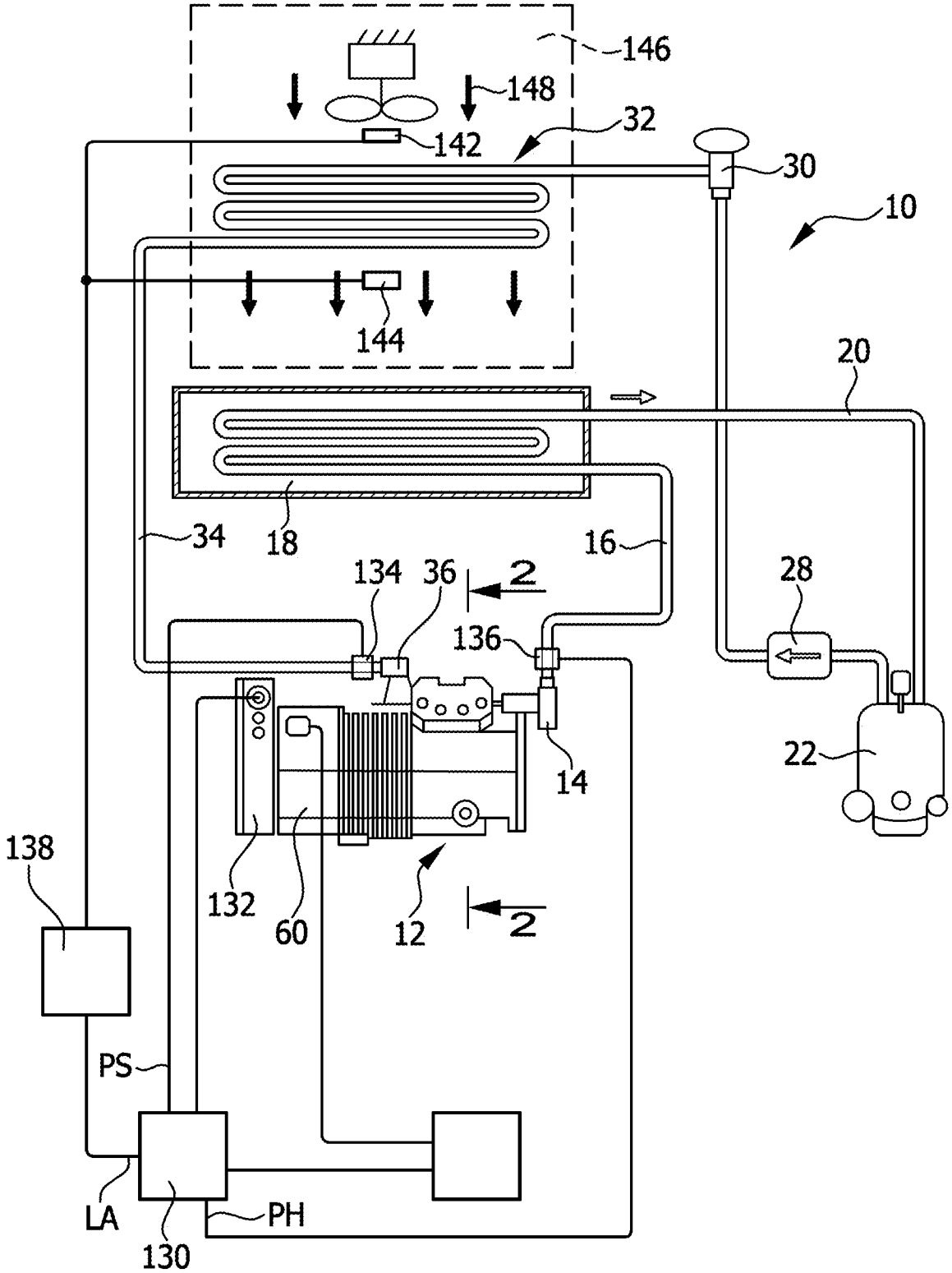
FIG. 1 shows a schematic illustration of a refrigeration system according to the invention.

One exemplary embodiment of a refrigeration system according to the invention, which is designated 10 as a whole, comprises a refrigerant compressor 12, from the high-pressure connector 14 of which a line 16 leads to a heat exchanger on the high-pressure side, which is designated 18 as a whole and in which the compressed refrigerant is condensed by the removal of heat to a heat sink, for example recirculated ambient air or other cooling media.

Liquid refrigerant flows from the heat exchanger 18 on the high-pressure side, along a line 20 to a collector 22, in which the liquid refrigerant collects and from which it then flows, via a line 28, to an expansion valve 30 for a heat exchanger 32 on the low-pressure side.

After flowing through the low-pressure heat exchanger 32, the evaporated refrigerant flows via a line 34 to a low-pressure connector 36 of the refrigerant compressor 12.

Figure 2:
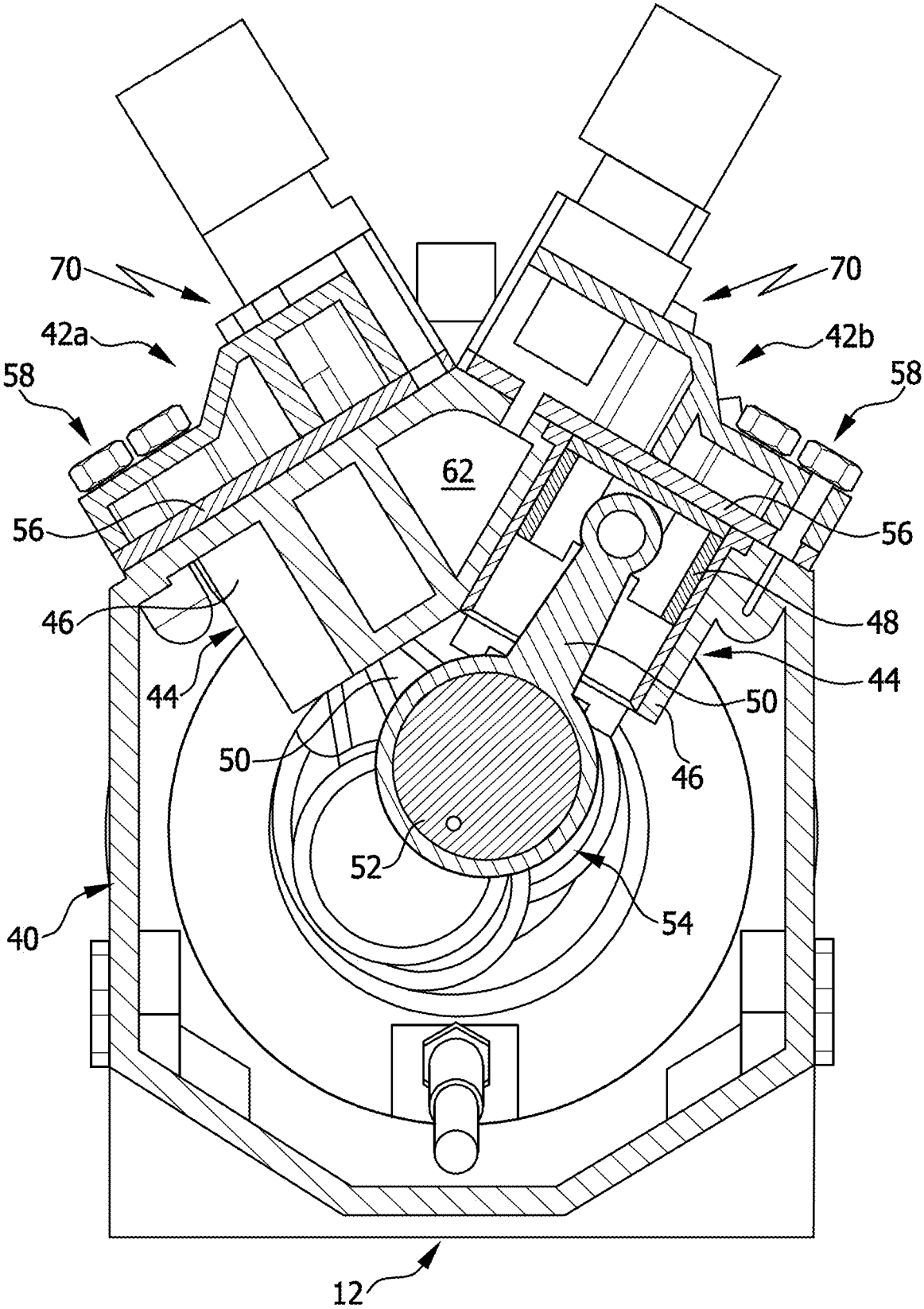
FIG. 2 shows a cross section along the line 2-2, through a refrigerant compressor of the refrigeration system according to the invention.

As illustrated in FIG. 2, the refrigerant compressor 12 according to the invention is configured as a reciprocating piston compressor, and comprises a compressor housing 40 in which there are provided for example two cylinder banks 42*a* and 42*b* that are arranged in a V shape in relation to one another and operate in parallel and of which each comprises at least one, in particular two or more cylinder units 44.

Each of these cylinder units 44 is formed from a cylinder housing 46, in which a piston 48 is movable in reciprocating manner in that the piston 48 is drivable by a piston rod 50, which is in turn seated on an eccentric 52 of an eccentric shaft 54 or is driven by a camshaft that is driven for example by an electric motor 60, which may be configured as a synchronous or asynchronous motor.

The cylinder housing 46 of each of the cylinder units 44 is closed off by a valve plate 56 on which there is arranged a cylinder head 58.

Preferably, in this context, the valve plate 56 covers not only one cylinder housing 46 of a cylinder unit 44 but all the cylinder housings 46 of the respective cylinder bank 42, and in the same way the cylinder head 58 likewise embraces all the cylinder housings 46 of the respective cylinder bank 42.

Further, the compressor housing 40 also comprises an inlet channel 62 that is in communication with the low-pressure connector 36 and is for example integrated into the compressor housing 40.

Figure 3:
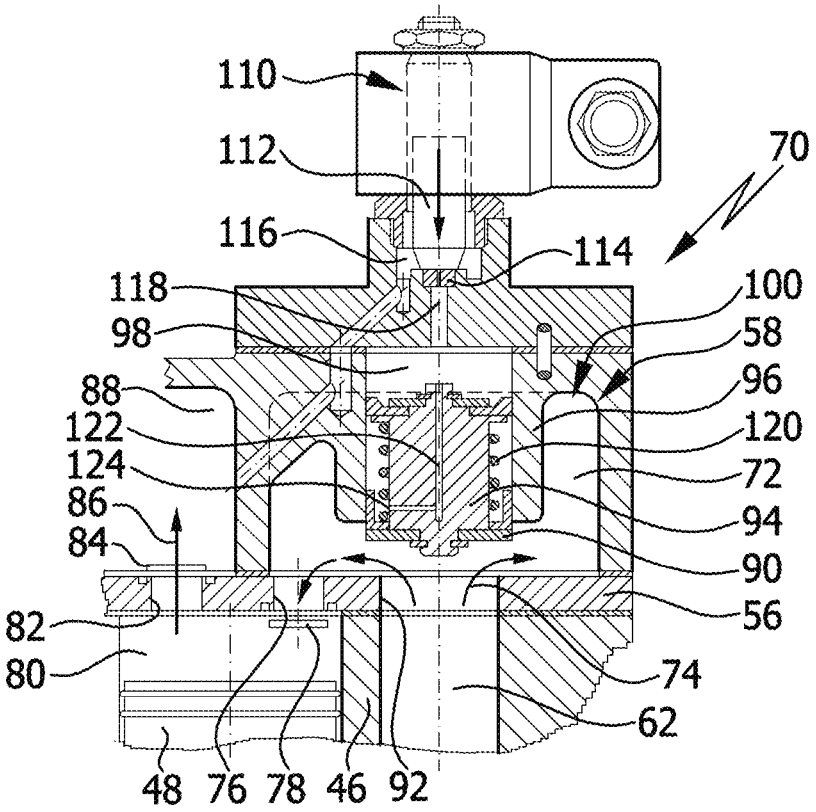
FIG. 3 shows a section through a mechanical performance control unit integrated into a cylinder head, in the open position of a valve body of the mechanical performance control unit.

As illustrated on a larger scale in FIG. 3, there is associated with at least one cylinder bank 42, in the case of the drawing each cylinder bank 42, a mechanical performance control unit that is designated 70 as a whole and that serves to allow an inlet stream 74 of refrigerant to pass from the inlet channel 62, through the valve plate 56 and into the respective cylinder head 58, in particular into an inlet chamber 72 thereof, in order thus to activate the respective cylinder bank 42, or to interrupt an inlet stream 74 of this kind in order thus to deactivate the respective cylinder bank 42.

If the mechanical performance control unit 70 is open, as illustrated in FIG. 3, the inlet stream 74 is able to pass through an inlet opening 76 provided in the valve plate 56 and an inlet valve 78 provided at the valve plate 56 and into a cylinder chamber 80 that is delimited by the respective piston 48 and the respective cylinder housing 46 and the valve plate 56, in order to be compressed in this cylinder chamber 80 by the reciprocating movement of the piston 48, with the result that an outlet stream 86 flows through an outlet opening 82 and an outlet valve 84 and out of the cylinder chamber 80 and enters an outlet chamber 88 of the cylinder head 58.

The mechanical performance control unit 70 is configured for example as a servo valve that is integrated into the cylinder head 58 and has a valve body 90 by means of which an inflow opening 92 to the inlet chamber 72, provided in the valve plate 56, is closable.

Further, the valve body 90 is arranged on an operating piston 94 that is guided in an operating cylinder housing 96 such that the operating piston 94 is movable in the direction of the valve plate 56 by a pressure prevailing in an operating cylinder chamber 98 in order to close off the inflow opening 92 therein.

In this arrangement, an operating cylinder unit 100, which is formed by the operating cylinder housing 96, the operating piston 94 and the operating cylinder chamber 98, and which is integrated into the cylinder head 58, is controllable by way of a control valve 110 that comprises an electromagnetically movable control piston 112 which is configured to close off a control valve seat 114, wherein the control piston 112 and the control valve seat 114 are provided for the purpose of interrupting or clearing a connection between a tubular-pressure channel 116 leading to the outlet chamber 88 and a pressure supply channel 118 for the operating cylinder 100, leading to the operating cylinder chamber 98.

Figure 4:
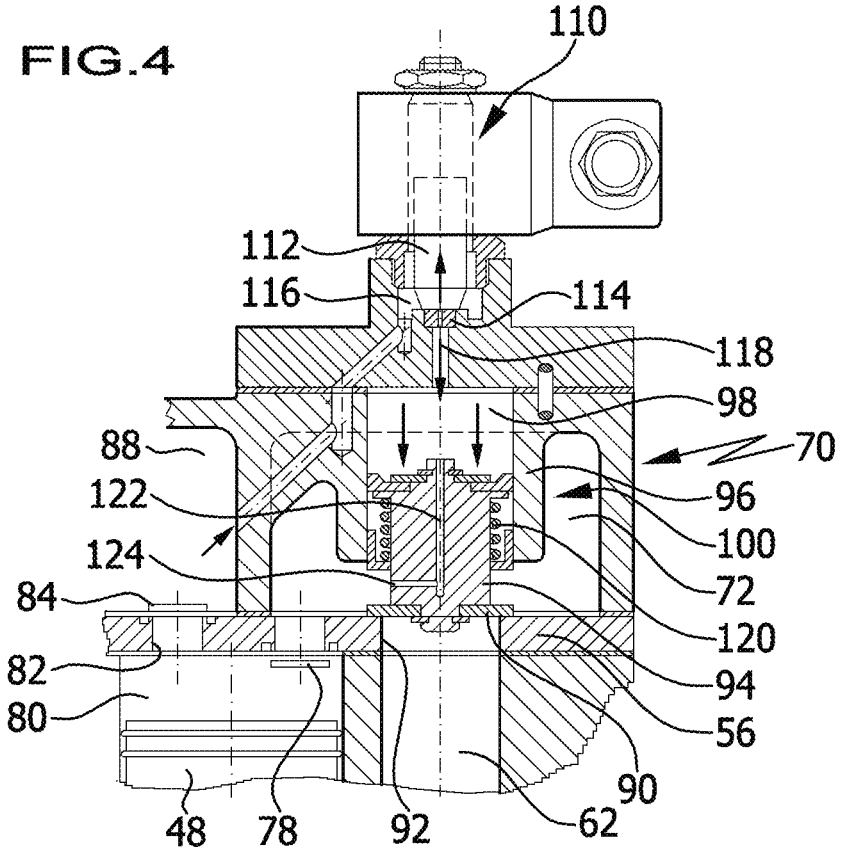
FIG. 4 shows a section similar to FIG. 3, in a closed position of the valve body of the mechanical performance control unit.
Figure 5:
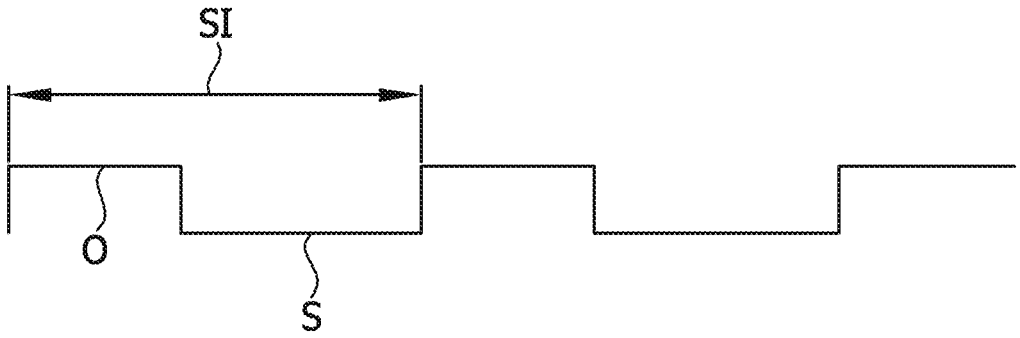
FIG. 5 shows a schematic illustration of a switching interval, comprising an open interval and a closed interval.

If the connection between the high-pressure channel 116 and the pressure supply channel 118 is cleared, the operating cylinder chamber 98 is subject to the high pressure prevailing in the outlet chamber 88, so the operating piston 94 moves in the direction of the valve plate 56 and presses the valve body 90 against it in order to close off the inflow opening 92 in the valve plate 56 (FIG. 4).

During this, the force acting on the operating piston 94 as a result of the high pressure in the operating cylinder chamber 98 is countered by the force of a resilient energy store 120 that is supported on the one hand against the operating cylinder housing 96 and on the other against the operating piston 94 such that the operating piston 94 moves away from the valve plate 56 and thus moves the valve body 90 into a position that clears the inflow opening 92.

In particular, the operating piston 94 is provided with a pressure relief channel 122, which leads from an opening facing the operating cylinder chamber 98 to an outlet opening 124 that is illustrated in FIG. 4 and opens into the inlet chamber 72 when the valve body 90 and the operating piston 94 are in the position in which the inflow opening 92 is closed off. In this case, the pressure relief channel 124 has the effect that, if the connection between the high-pressure channel 116 and the pressure supply channel 118 is interrupted, the pressure in the operating cylinder chamber 98 quickly collapses and thus, under the action of the resilient energy store 120, the operating piston 94 and the valve body 90 move into a position that clears the inflow opening 92, illustrated in FIG. 3.

The mechanical performance control unit 70 is controllable by an operating condition controller 130, illustrated in FIG. 1, such that this mechanical performance control unit 70 may provide closing or opening in order to activate or deactivate the respective cylinder bank 42*a*, 42*b* and thus to put the refrigerant compressor 12 in an operating mode B that defines the scope of activation and deactivation of the cylinder banks 42.

Moreover, as a result of the operating condition controller 130, the electric motor 60 is also controllable, in particular by the control of a frequency converter 132 of the electric motor 60, in order to enable this to be operated at variable speed and hence, when a suitable operating mode is used, to be able to achieve the required load condition or partial performance condition.

Furthermore, the operating condition controller 130 detects the respective load condition or partial performance condition of the refrigerant compressor 12, for example by measuring the suction pressure PS with the aid of a suction pressure sensor 134 that is close to or on the low-pressure connector 36, and a high pressure PH with the aid of a high-pressure sensor 136 that is arranged close to or on the high-pressure connector 14.

Further, the electric power consumed by the electric motor 60 can also be detected with the aid of the frequency converter 132.

Moreover, also transmitted to the operating condition controller 130 is a performance request signal LA that is generated by a system controller 138 that detects the refrigeration performance that is requested at the low-pressure heat exchanger 32, for refrigerating an object 146, for example a refrigeration cabinet, for example by temperature sensors 142 and 144 which are associated with the low-pressure heat exchanger 32 and which enable the temperatures of a medium 148 flowing through the low-pressure heat exchanger 32 and the object 146 to be detected, for example upstream and downstream of the low-pressure heat exchanger 32, and to be compared with a requested temperature of the medium 146.

The operating condition controller 130 is able to adapt the refrigeration performance of the refrigeration system 10 to the refrigeration performance required for refrigeration of the object 146, predetermined by the performance request signal LA, on the one hand by selecting a suitable operating condition B and on the other by regulating the speed of the electric motor 60 with the aid of the frequency converter 132.

Here, however, as a result of the construction of the electric motor 60 only a limited speed range is available for adaptation of the speed, and this range has likewise to be taken into account when selecting the suitable operating mode.

The operating modes B that are possible in partial performance conditions may for example provide:

- operation of the refrigerant compressor 12 with all the cylinder banks 42 in the activated condition, and only adaptation to the partial performance condition by adaptation of the speed of the electric motor 12 by the frequency converter 132,
- operation of the refrigerant compressor 12 with active and inactive cylinder banks 42 and with adaptation of the speed of the electric motor 12 by the frequency converter 132 to the scope of the active and inactive cylinder banks,
- operation of the refrigerant compressor 12 with only one active cylinder bank 42 and with adaptation to the partial performance condition by adaptation of the speed of the electric motor 12 by the frequency converter.

Activation or deactivation of at least one of the cylinder banks 42*a*, 42*b* may for example be performed with a first type of the operating modes over the entire period of the respective partial performance condition, with the result that, for example during a particular period during which a partial performance condition of X % of the full load condition is required, one cylinder bank 42 is permanently deactivated and the refrigerant compressor 12 operates with the respectively other, active cylinder bank 42, and moreover there is a corresponding adaptation of the speed of the electric motor by correspondingly controlling the frequency converter 132.

As an alternative, however, it is also possible with a second type of the operating modes to activate or deactivate at least one cylinder bank 42*a*, 42*b* or both cylinder banks 42 in clocked manner during the period of a partial performance condition, and moreover to suitably adapt the speed of the electric motor 60 by controlling the frequency converter 132.

For this purpose, the mechanical performance control unit 70 is configured to be controlled by the operating condition controller 130 illustrated in FIG. 1 such that the mechanical performance control unit 70 is closed and opened at continuously succeeding switching intervals SI by the operating condition controller 130, wherein each of the switching intervals SI has an open interval O during which the valve body 90, in its clearing position, allows the inlet stream 74 to pass through the inflow opening 92 and activates the corresponding cylinder bank 42, and a closed interval S during which the valve body 90, as illustrated in FIG. 4, in its closing position, blocks flow of the inlet stream 74 through the inflow opening 92 and thus deactivates the corresponding cylinder bank 42.

Within the duration of the respective switching interval SI it is possible, for the purpose of predetermining the respective operating mode, to variably adjust the period of the open interval O and the closed interval S in relation to one another, with the result that either the open interval O is larger than the closed interval or vice versa.

In the extreme case, the open interval O can last for substantially the entire duration of the switching interval SI while the closed interval S becomes vanishingly small, or conversely it is also possible for the closed interval S to last for substantially the entire duration of the switching interval SI, with the result that the open interval O becomes vanishingly small.

Because, in the refrigeration system 10 according to the invention, liquid refrigerant is typically constantly evaporating by way of the expansion valve 30, interrupting the compression of refrigerant by the refrigerant compressor 12 results in a rise in the temperature T in the low-pressure heat exchanger 32.

Figure 6:
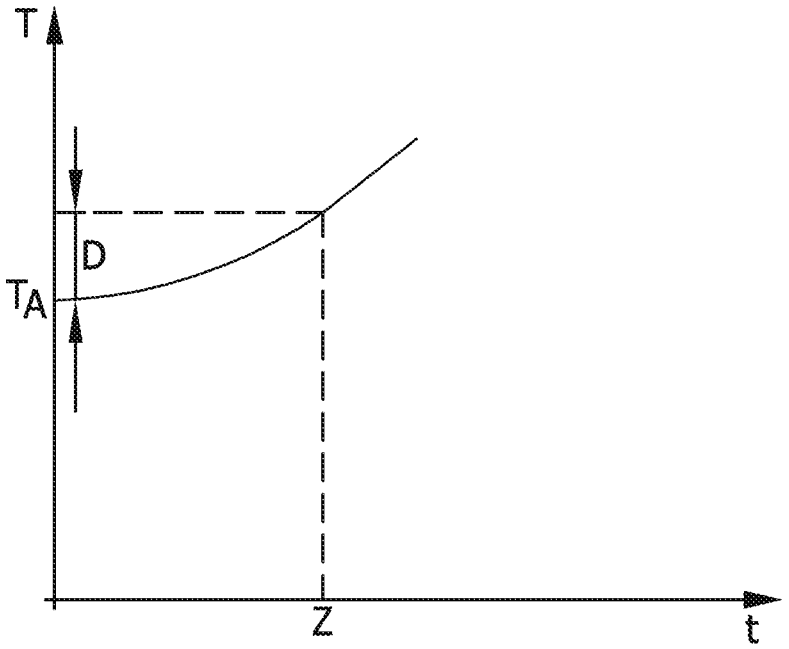
FIG. 6 shows a schematic illustration of a behaviour of the temperature of the heat exchanger that is on the low-pressure side in the refrigeration system when the compression of refrigerant is interrupted.

However, the system has sluggish reactions, so when there is an interruption in the removal by suction of refrigerant from the low-pressure heat exchanger 32 the temperature T of the low-pressure heat exchanger 32 does not rise immediately but, as illustrated in FIG. 6, needs a time Z to elapse in order to increase a value D.

As long as the value D lies at values 10% smaller than a starting temperature $T_A$ of the low-pressure heat exchanger, these fluctuations are irrelevant to functioning of the refrigeration system according to the invention.

For this reason, the switching interval SI is selected such that it is shorter than the time Z that elapses until the temperature T of the low-pressure heat exchanger 32—starting from a temperature $T_A$ of the low-pressure heat exchanger 32—has risen by a value D of approximately 10%, or preferably approximately 5%, if there is a sudden interruption to the removal by suction of refrigerant from the low-pressure heat exchanger 32 and to the supply of medium under high pressure to the high-pressure connector 14.

This ensures that the open intervals O and the closed intervals S within the respective switching interval SI do not have a substantial effect on functioning of the refrigeration system, and only result in slight fluctuations in the temperature of the low-pressure heat exchanger 32 of the refrigeration system according to the invention.

Usually, the durations of the switching intervals SI are durations shorter than approximately 10 seconds, preferably shorter than approximately 5 seconds.

On the other hand, in order to ensure sufficient open intervals O, the switching intervals are longer than approximately 1 second, preferably longer than 2 seconds.

A preferred operating range provides switching intervals SI of a duration between 2 and 10 seconds.

In order to ensure switching intervals SI as short as this, it is preferably provided for the operating pistons 94, together with the valve body 90 and the resilient energy stores 120, overall to have a resonant frequency that is greater than the frequency corresponding to the maximum switching intervals SI, with the result that the operating pistons 94 are able to achieve the open intervals O and the closed intervals S within the switching intervals SI, substantially without delay.

Preferably, the resonant frequencies of the systems comprising operating piston 94, valve body 90 and resilient energy store 120 are greater than the frequencies corresponding to the switching intervals SI by a factor of at least 5 or preferably at least 10.

Moreover, the operating condition controller 130 is able to identify or detect the quality grade or COP value of the refrigerant compressor 12 in the respective operating mode and in the respective load condition or partial performance condition, wherein the quality grade or COP value is dependent in particular on the refrigerant used, the speed of the electric motor 60, the number of active cylinder banks 42 and the ratio of high pressure PH to suction pressure SP.

Where there is precise calculation, the quality grade or COP value is determined for example in conformance with the following publication:

Compressors and condensing units for refrigeration—Performance testing and test methods—Part 1, Refrigerant compressors in particular Section 4.1.5.2 and for example equation 7 of European Standard CEN/TC 113, Date 2014-04, prEN 13 771-1:2014.

The refrigerant compressor 12 therefore provides the possibility, where a plurality of operating modes are available for producing a partial performance condition requested by the performance request signal, with the aid of the operating condition controller 130 of optimising operation of the refrigerant compressor 12 in respect of maximum possible efficiency in the partial performance conditions—which is expressed as the highest possible quality grade or COP value or the lowest possible electrical power consumption by the electric motor 60—by selecting a suitable operating mode of the refrigerant compressor 12, and of providing the open or closed-loop control of a speed of the electric motor 60 that is suitable for the respective operating mode in this partial performance condition by controlling the frequency converter 132 in order to carry out operation in the partial performance condition provided.

This taking into account or determination of the quality grade or COP value or electrical power consumption for the respectively possible operating modes B may be performed in advance, or may be performed while operation of the refrigerant compressor 12 is running by retrieving data that was determined in advance in test runs and stored in the operating condition controller 130. For this purpose, there is associated with the respectively possible operating modes B for this partial performance condition or the respectively possible operating modes B of a group of possible partial performance conditions in each case a quality grade or COP value or electrical power consumption, such that the operating condition controller 130 for the partial performance condition requested by the performance request signal LA can select the operating mode B with the respectively most favourable quality grade or COP value or the lowest electrical power consumption and can operate the refrigerant compressor 12 in accordance with this operating mode B.

A further possibility provides for the refrigerant compressor 12 to be operated in the possible operating modes B with the respective partial performance condition and for the power consumed by the electric motor 60 to be detected in each operating condition such that the operating condition controller 130 can then assess and store the operating mode B with the lowest electrical power consumption and the greatest efficiency and in future use only this operating mode B as the one with the greatest efficiency for this partial performance condition.

Figure 7:
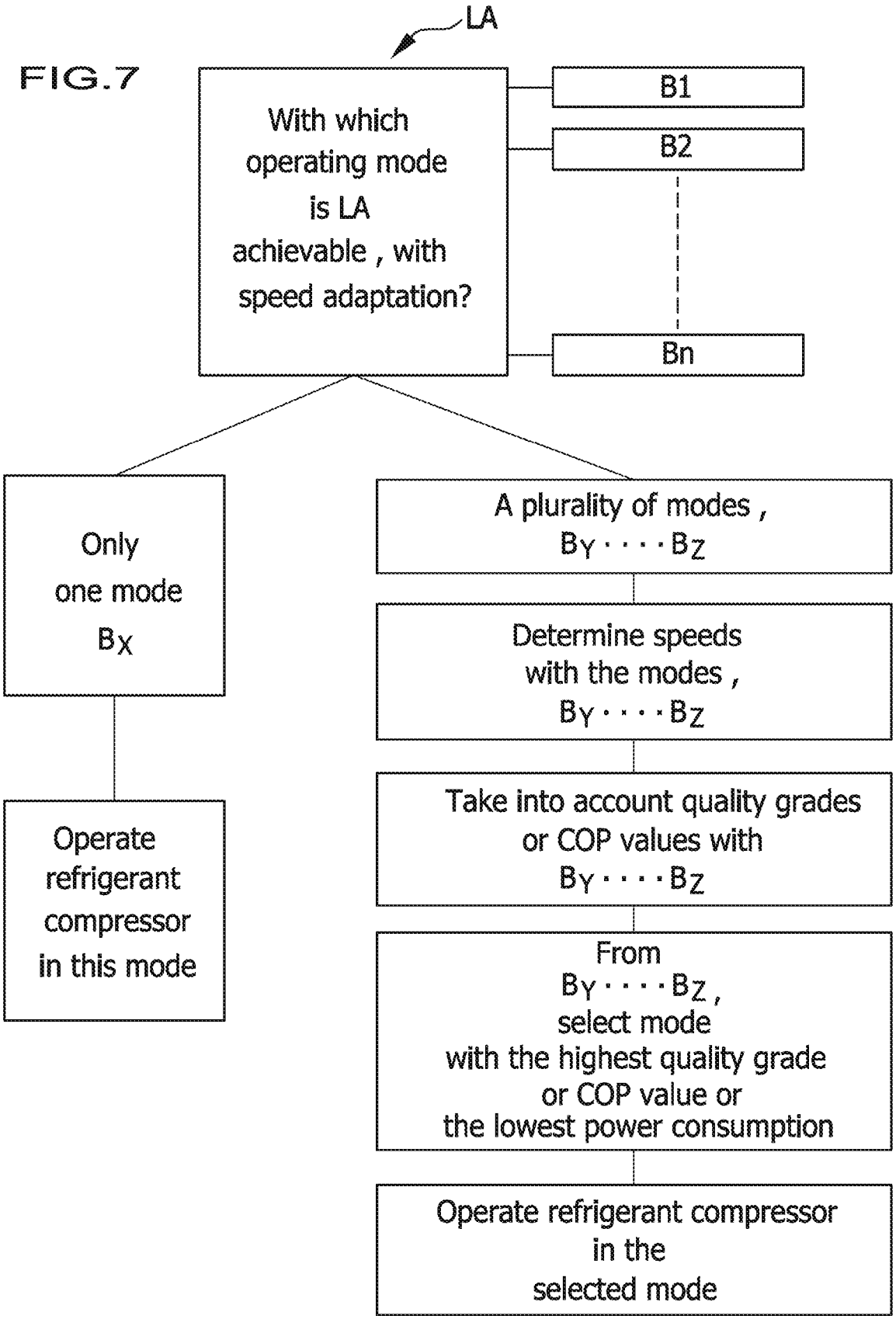
FIG. 7 shows a flow chart for the purpose of illustrating the procedure according to the invention.

The procedure for selection of the possible operating mode B by the operating condition controller 130 is illustrated in FIG. 7.

First, when a performance request LA is received by the operating condition controller 130, a check is made as to whether only one operating mode B or a plurality of operating modes B is/are available for achieving this performance request LA.

Typically, with a partial performance condition that is close to the maximum performance of the refrigerant compressor 12, only one operating mode $B_x$ is available, namely that at which all the cylinder banks 42 are activated to their full extent and adaptation to the partial performance condition is performed by regulating the speed of the drive motor 60.

In the case of partial performance conditions that are in the middle or low performance range, typically it is possible to select from a plurality of operating modes $B_y$ to $B_z$, depending on how many cylinder banks 42 are available and whether the refrigerant compressor 12 can be operated with the first type of operating modes and/or the second type of operating modes.

The speed of the electric motor 60 that is required to achieve the requested partial performance condition is then determined for each of these operating modes, and on this basis the quality grade or COP value or electrical power consumption is then taken into account or determined in the manner described above.

Using the quality grade or COP value or electrical power consumption that is associated with the respective operating mode $B_y$ to $B_z$, it is possible to select the operating mode with the best quality grade or COP value or the lowest electrical power consumption, and this operating mode is then used by the operating condition controller 130 for operation of the refrigerant compressor 12 in order to achieve the partial condition requested by the load request signal LA.

The general procedure explained above is explained in detail below by way of the example of the exemplary embodiment of the refrigerant compressor 12 described initially, with reference to a simplified procedure for determining the quality grade or COP value or electrical power consumption.

Figure 8:
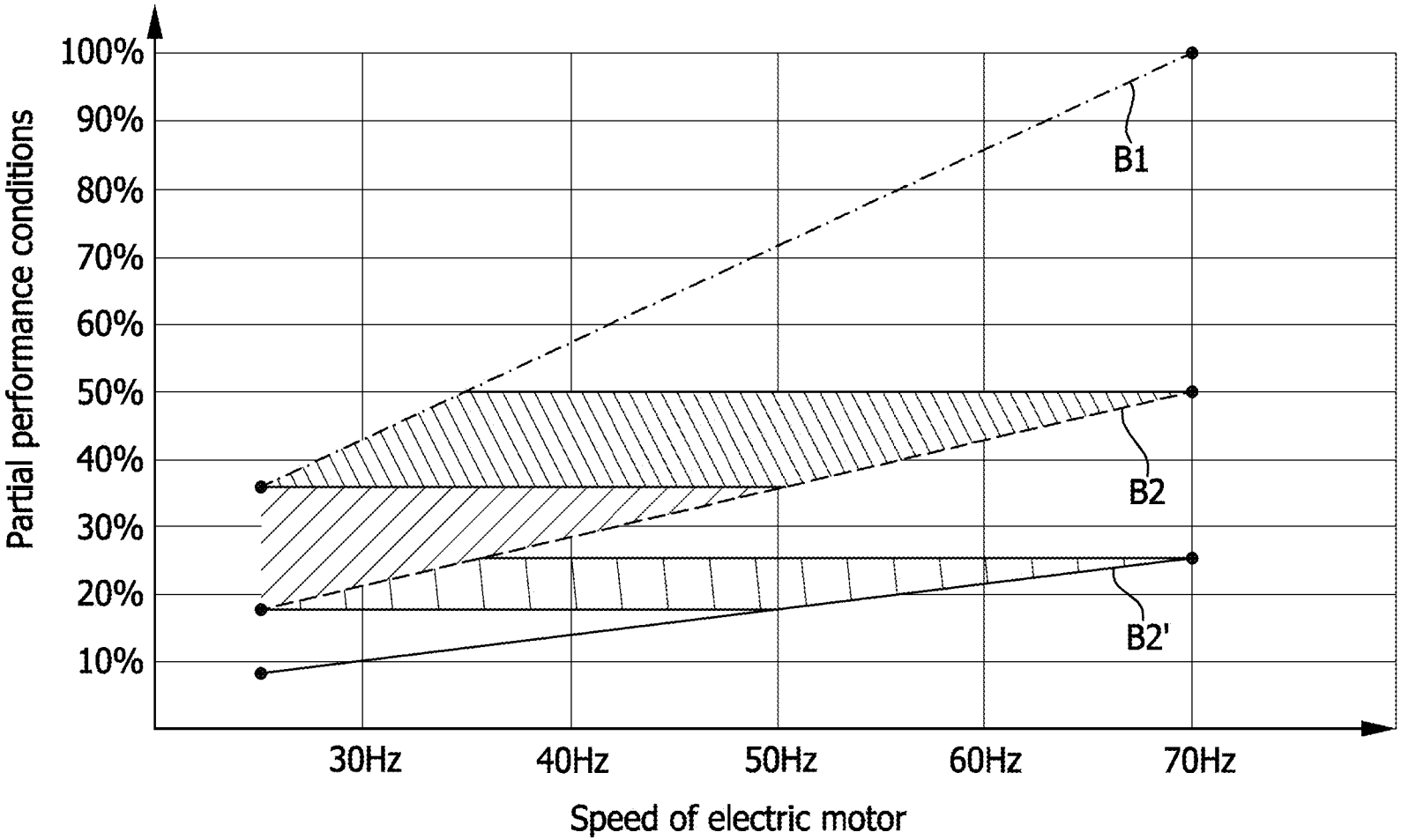
FIG. 8 shows an illustration of the performance conditions of the refrigerant compressor according to FIG. 2, in a first and a second operating mode.

In the case of the refrigerant compressor which, according to the first exemplary embodiment, has two cylinder banks 42*a* and 42*b*, in the partial performance condition with restriction to the first type of operating modes, the only possibility is to operate this in a first operating mode B1 in which both cylinder banks 42*a* and 42*b* are active, or to operate it in a second operating mode B2 in which only one of the cylinder banks 42*a*, 42*b* is active and the other is inactive, as illustrated in FIG. 8.

In each of the operating modes B1, B2, it is possible to vary the speed of the electric motor 60 with the aid of the frequency converter 132, for example between 25 Hz and 70 Hz.

Because in the case of partial performance conditions above 50% all the cylinder banks 42*a*, 42*b* must be active, these are only achievable in operating mode B1, and partial performance conditions below 35% are only achievable by deactivating one of the cylinder banks 42*a*, 42*b*, and thus only in operating mode B2, with the result that it is only in the case of partial performance conditions between 35% and 50% that optimisation is possible by taking into account the quality grade or COP value, since in the partial performance conditions between 35% and 50% the refrigerant compressor 12 can either be operated in the first operating mode B1 or in the second operating mode B2.

For this reason, a selection between the first operating mode B1 and the second operating mode B2 is possible by determining the quality grade or COP value of these operating modes.

In order for example to be able to take into account the quality grade or COP value or electrical power consumption in a simplified manner, the possible partial performance conditions between 35% and 70% are divided into two groups, for example, in the simplest case, depending on the high pressure PH detected by the high-pressure sensor 136.

If, with a certain refrigerant, the high pressure PH is for example above a high-pressure threshold value PHG, then the operating mode B2 is selected; if the high pressure PH is below the threshold value PHG, then the operating mode B1 is selected.

With the operating modes B1 and B2 of the first type, in each case the corresponding cylinder bank is constantly activated or deactivated throughout the time during which a partial performance condition is achieved.

However, because operating modes of the second type may likewise be achieved in which the respective cylinder bank 42 may be activated or deactivated for proportions of the time during succeeding switching intervals SI, the first exemplary embodiment of the refrigerant compressor according to the invention also provides the possibility, for example selecting only one of the cylinder banks 42 and by clocked activation and deactivation of this one cylinder bank 42 within the switching intervals SI, for example in the ratio 1:1, and by deactivating the other cylinder bank 42, of selecting the operating mode B2', in which even lower partial performance conditions are possible, in which case for example in a partial performance range between 17% and 25% it is possible to optimise operation of the refrigerant compressor 12, likewise in respect of the quality grade or COP value, by making a selection between the operating condition B2 and the operating condition B2', wherein for example likewise at a high pressure PH that is above the high-pressure threshold value PHG the operating mode B2' is selected, whereas at a high pressure PH that is below the threshold value PHG the operating mode B2 is selected.

However, depending on the refrigerant used, these conditions may also be reversed.

Figure 9:
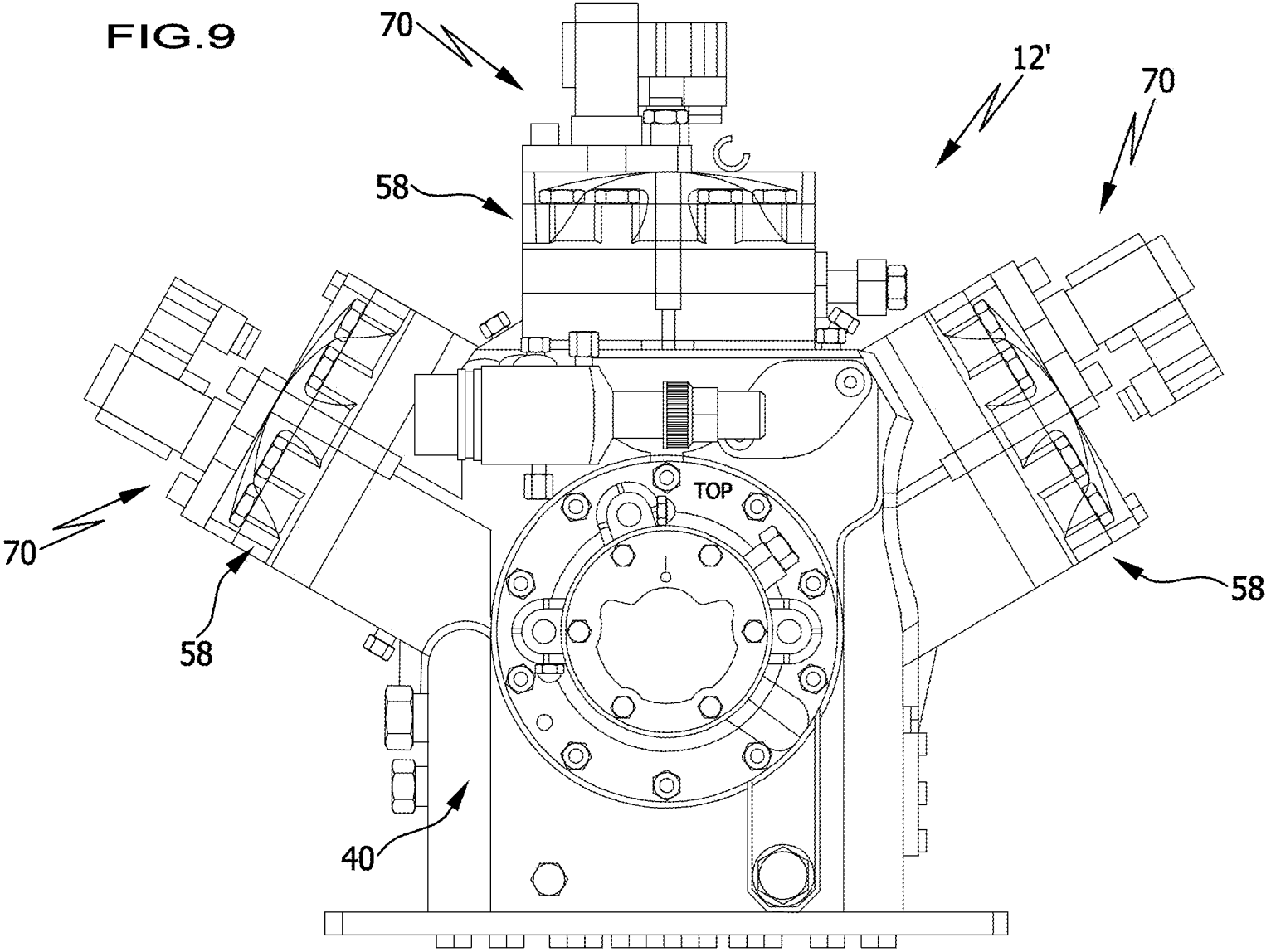
FIG. 9 shows an illustration of a second exemplary embodiment of a refrigerant compressor, the structural principle of which corresponds to that of the first exemplary embodiment.
Figure 10:
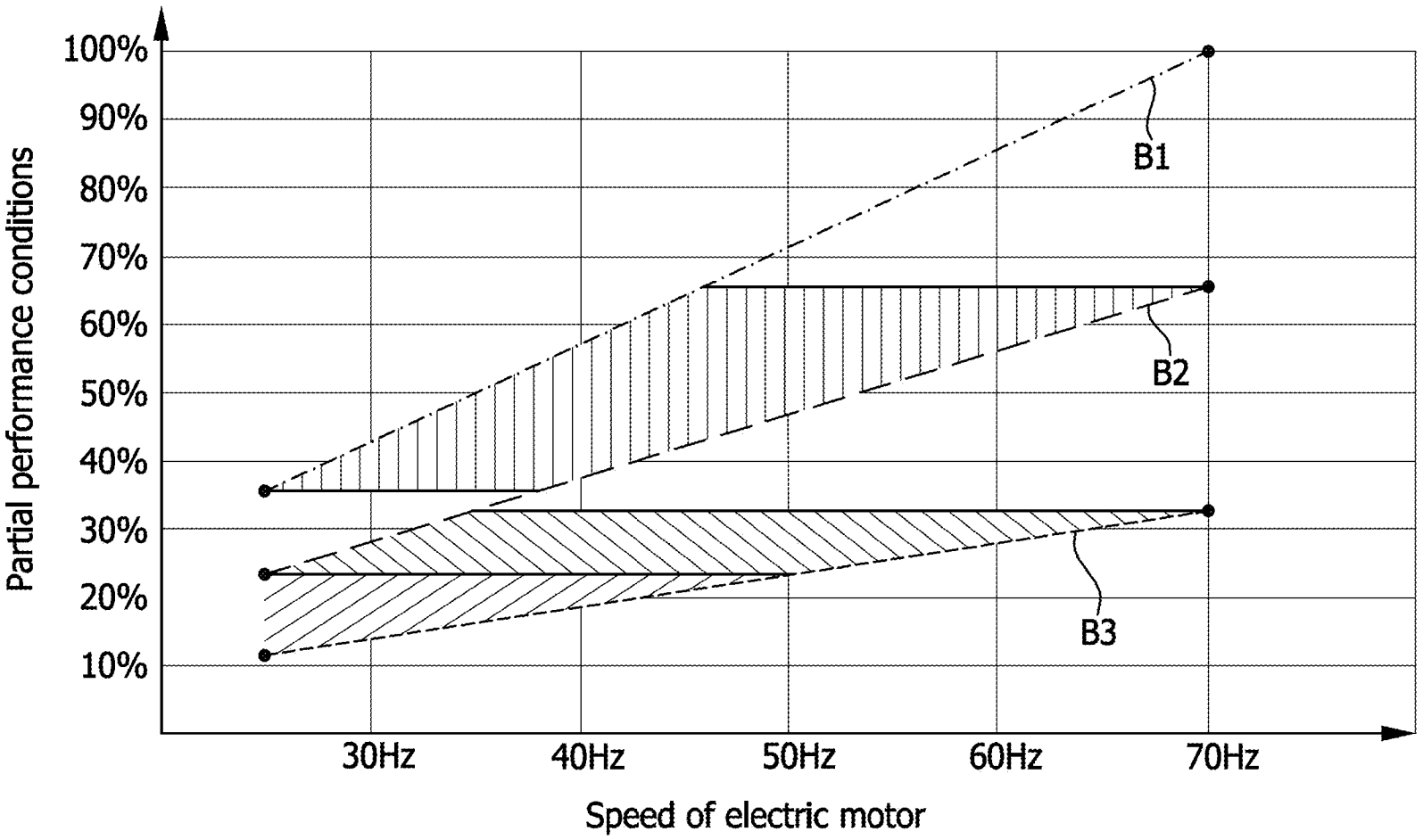
FIG. 10 shows an illustration of the performance conditions of the refrigerant compressor according to FIG. 9, in a first, a second and a third operating mode.
Figure 11:
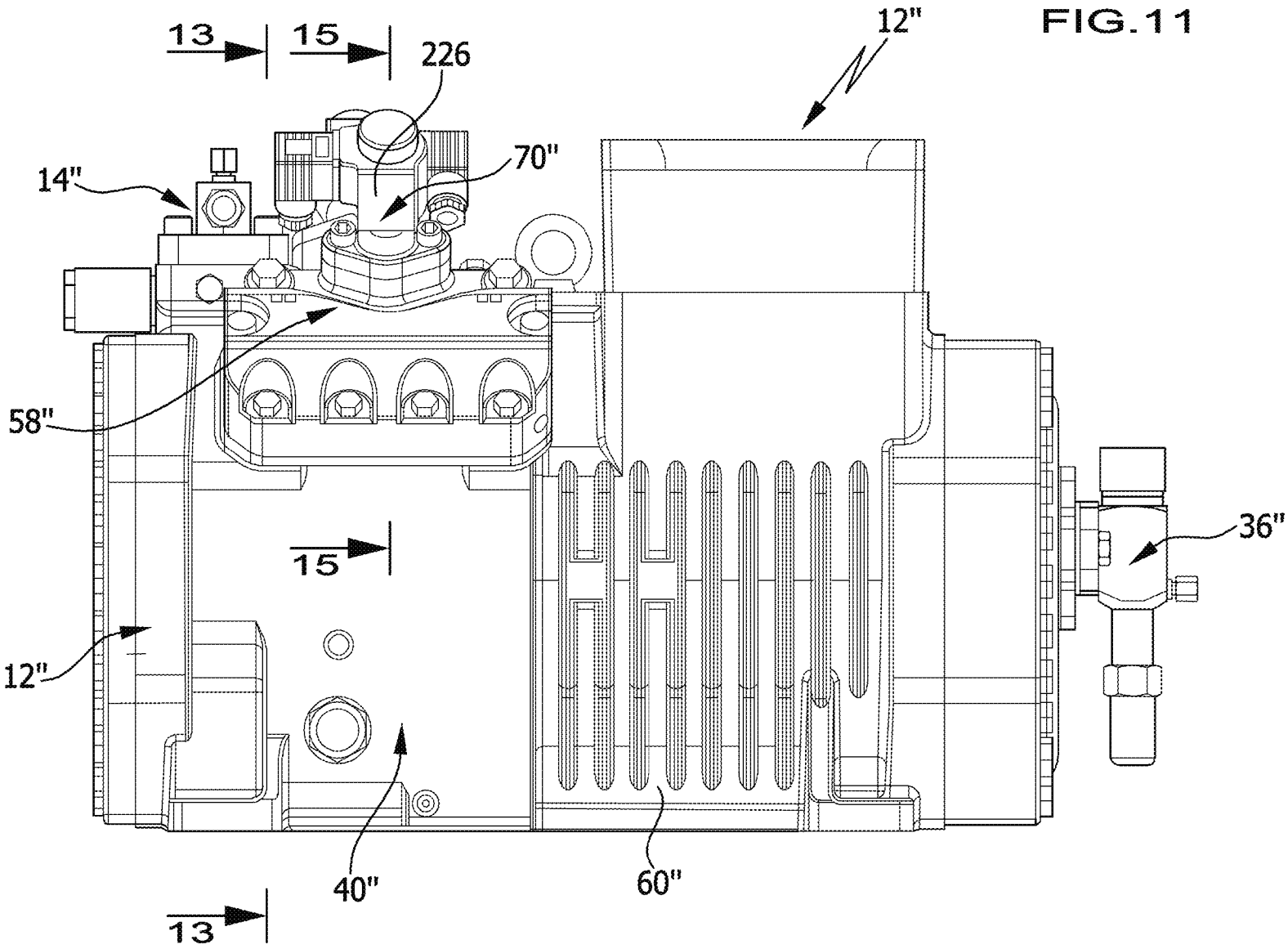
FIG. 11 shows a side view of a third exemplary embodiment of a refrigerant compressor according to the invention.
Figure 12:
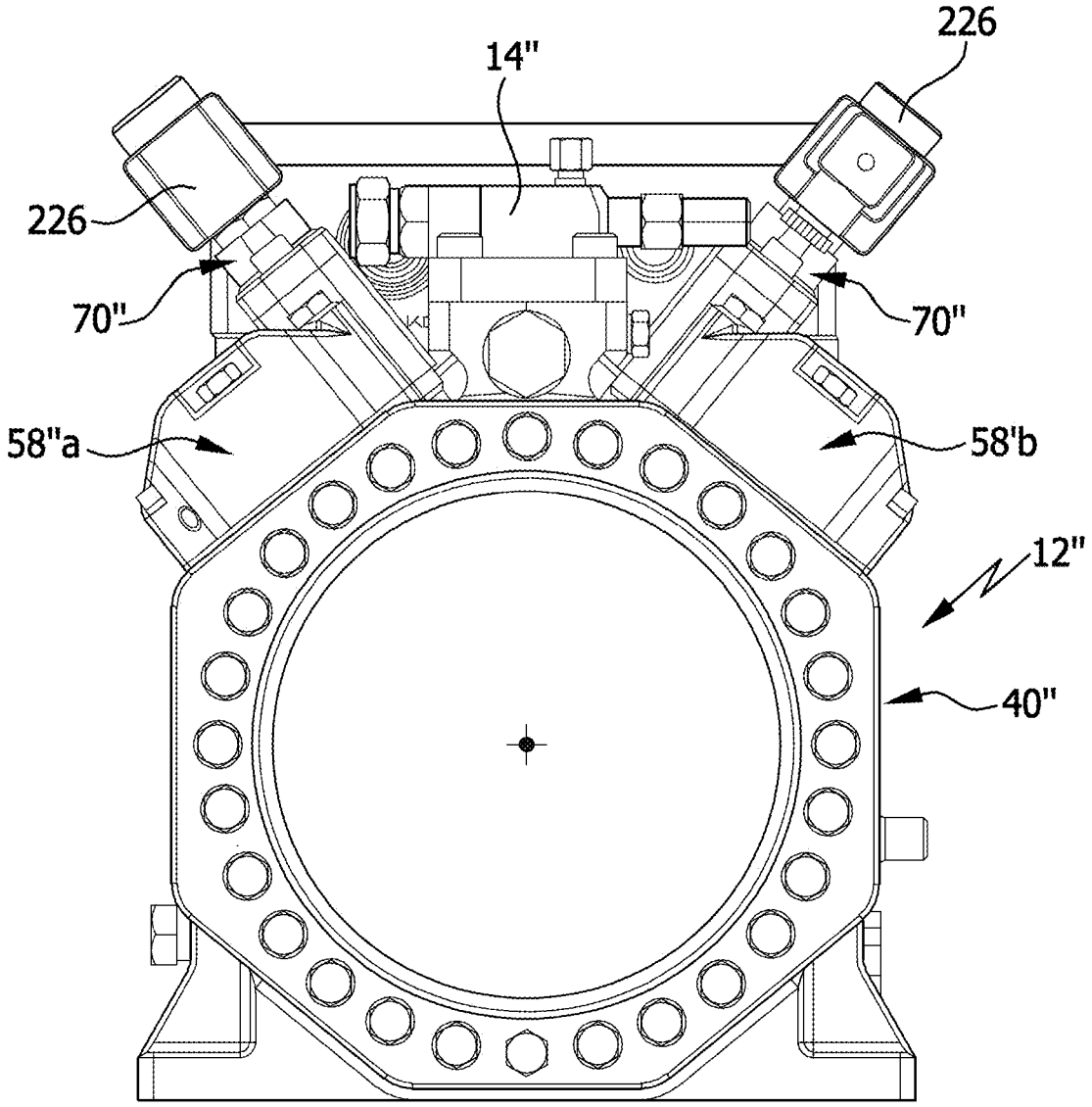
FIG. 12 shows a front view of the third exemplary embodiment of the refrigerant compressor according to the invention.

If, according to a second exemplary embodiment, a refrigerant compressor 12' having three cylinder banks 42*a*, 42*b* and 42*c* is used (FIG. 9), for example having in each case two cylinders per cylinder bank 42, wherein each of the cylinder banks 42*a*, 42*b* and 42*c* is activatable or deactivatable individually with the aid of an associated mechanical performance control unit 70, then—as illustrated in FIG. 10—three operating modes B1, B2, B3 are possible, namely the first operating mode B1 with all the cylinder banks 42*a*, 42*b* and 42*c* in the activated condition, a second operating mode B2 with two of the cylinder banks 42 in the activated condition, and a third operating mode with only one of the cylinder banks 42 in the activated condition.

As regards the detailed construction, the second exemplary embodiment corresponds to the first exemplary embodiment.

In this exemplary embodiment, in the case of a partial performance condition in the range between 35% and 65%, it is possible to make a selection between the operating modes B1 and B2, and in the range between 23% and 33%, it is possible to make a selection between the operating modes B2 and B3.

In this second exemplary embodiment too, for reasons of simplicity of the procedure during determination of the quality grade, the partial performance conditions are divided into two groups by establishing a high-pressure threshold value PHG, wherein at a high pressure PH above the high-pressure threshold value PHG, on selection between the operating modes B1 and B2 the operating mode B2 is selected, and on selection between the operating modes B2 and B3 the operating mode B3 is selected, whereas at a high pressure PH below the high-pressure threshold value PHG, on selection between the operating modes B1 and B2 the operating mode B1 is selected, and on selection between the operating modes B2 and B3 the operating mode B2 is selected.

Otherwise, in the same manner as in the first exemplary embodiment, the maximum partial performance conditions are achievable with the operating mode B1 and the minimum partial performance conditions are achievable with the operating mode B3 and respective adaptation of the speed of the electric motor 60.

A third exemplary embodiment of a refrigerant compressor 12", which is particularly suitable where $CO_2$ is the refrigerant, comprises a high-pressure connector 14" and a low-pressure connector 36".

Figure 13:
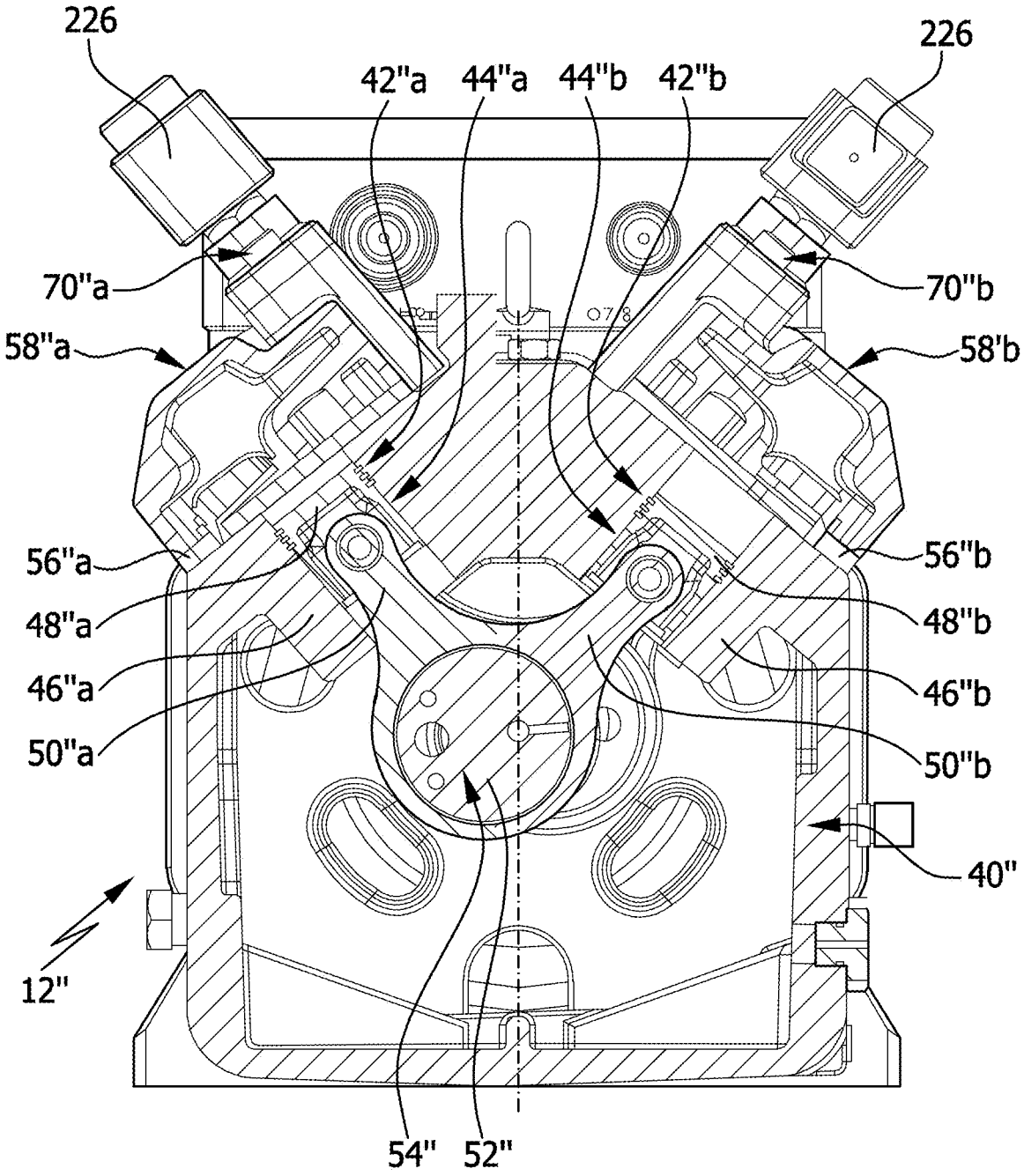
FIG. 13 shows a section, offset to one side, along the line 13-13 in FIG. 11.
Figure 14:
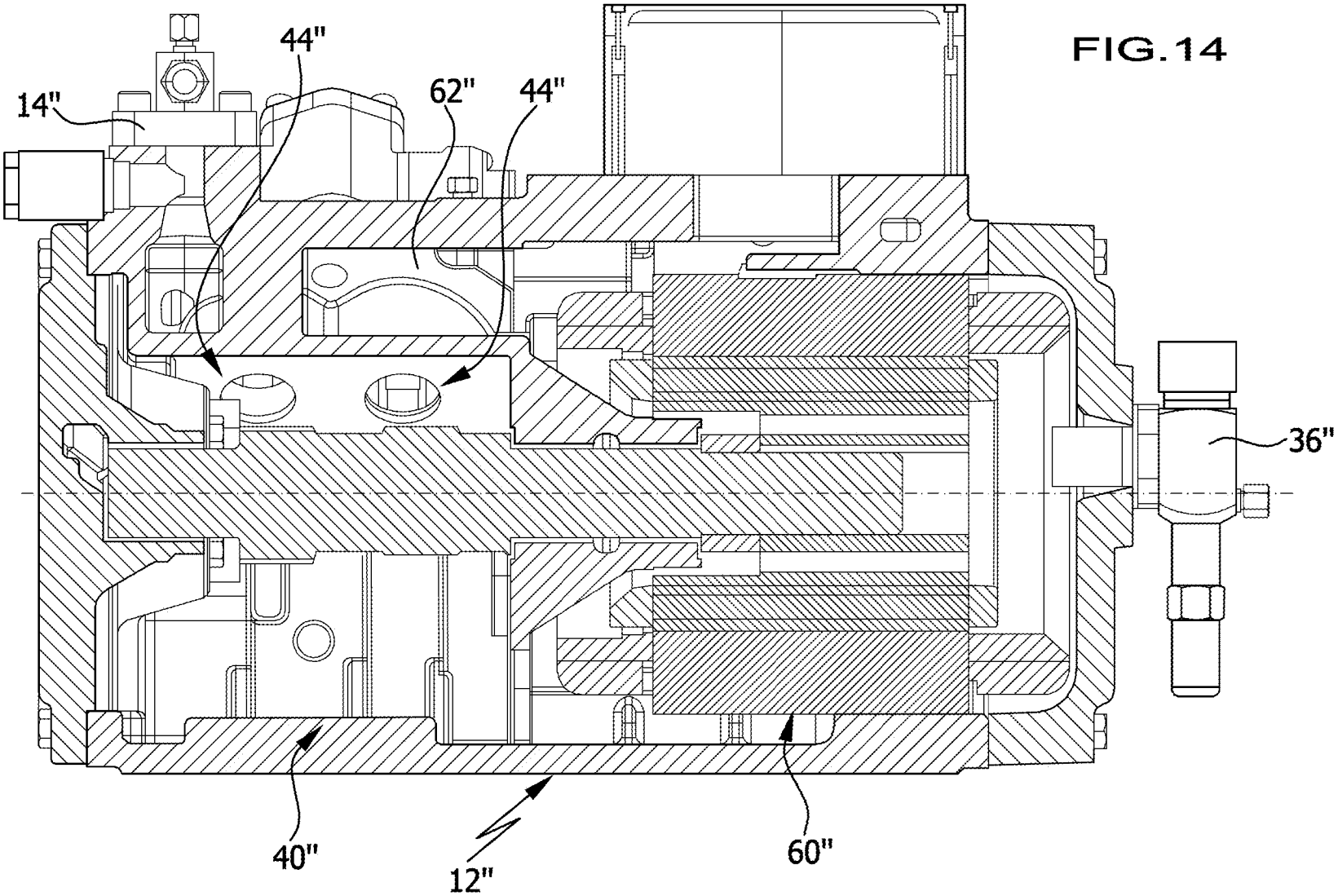
FIG. 14 shows a longitudinal section through the third exemplary embodiment of the refrigerant compressor according to the invention.

As illustrated in FIG. 13, the refrigerant compressor 12" is configured as a reciprocating piston compressor and comprises a compressor housing 40" in which there are provided for example two cylinder banks 42"*a* and 42"*b* that are arranged in a V shape in relation to one another and work in parallel and of which each comprises at least one, in particular two or more cylinder units 44".

Each of these cylinder units 44" is formed from a cylinder housing 46", in which a respective piston 48" is movable in reciprocating manner in that the piston 48" is drivable by a respective piston rod 50", which is in turn seated on an eccentric 52" of an eccentric shaft 54" that is driven for example by an electric motor 60", which may be configured as a synchronous or asynchronous motor.

The cylinder housing 46" of each of the cylinder units 44" is closed off by a valve plate 56" on which there is arranged a cylinder head 58".

Preferably, in this context, the valve plate 56" covers not only one cylinder housing 46" of a cylinder bank 42" but all the cylinder housings 46" of the respective cylinder bank 42", and in the same way the cylinder head 58" likewise embraces all the cylinder housings 46" of the respective cylinder bank 42".

Further, the compressor housing 40" also comprises an inlet channel 62" that is in communication with the low-pressure connector 36" and is for example integrated into the compressor housing 40".

Figure 15:
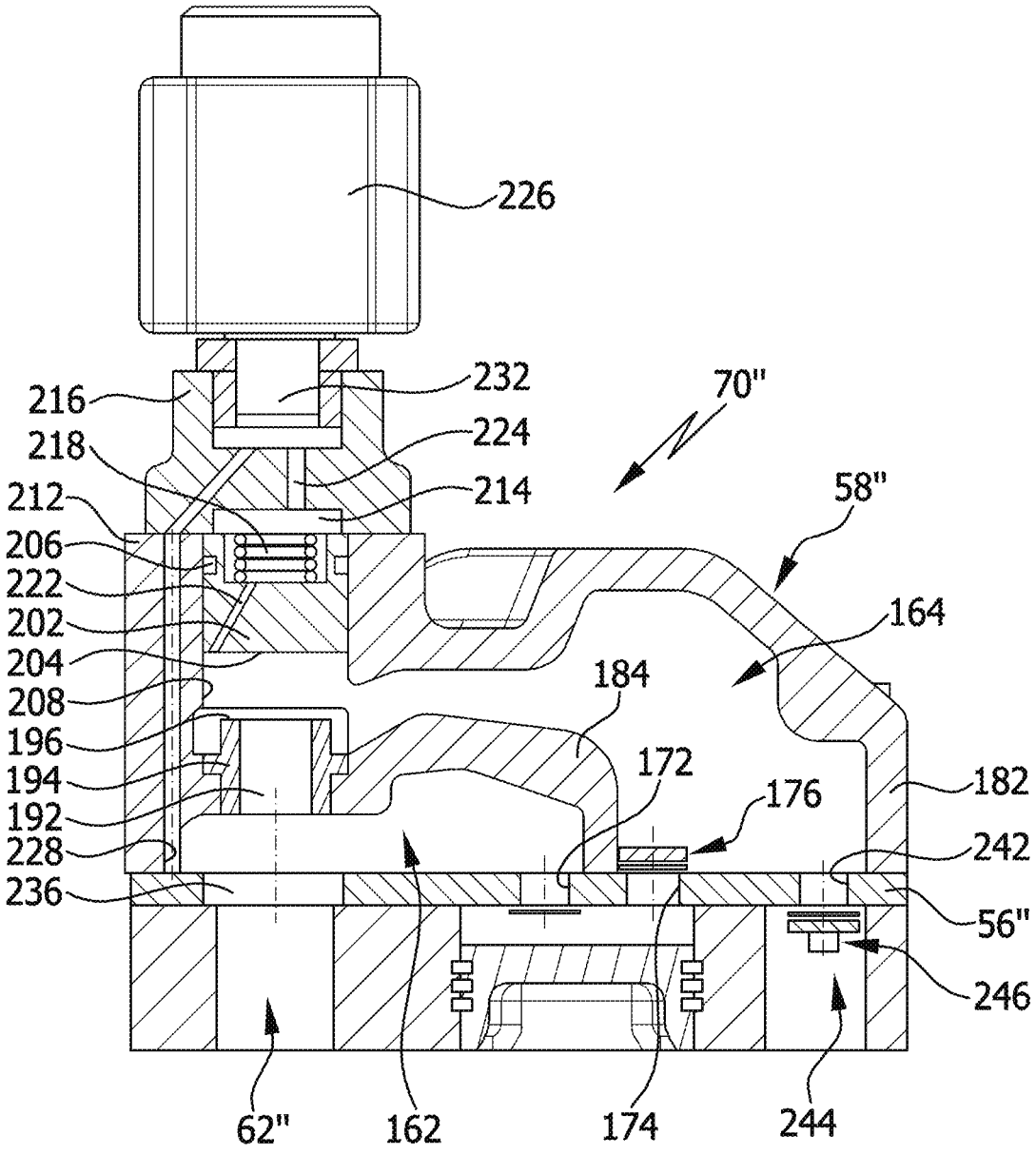
FIG. 15 shows a section along the line 15-15 in FIG. 11, with a connection channel between the inlet chamber and the outlet chamber open.
Figure 16:
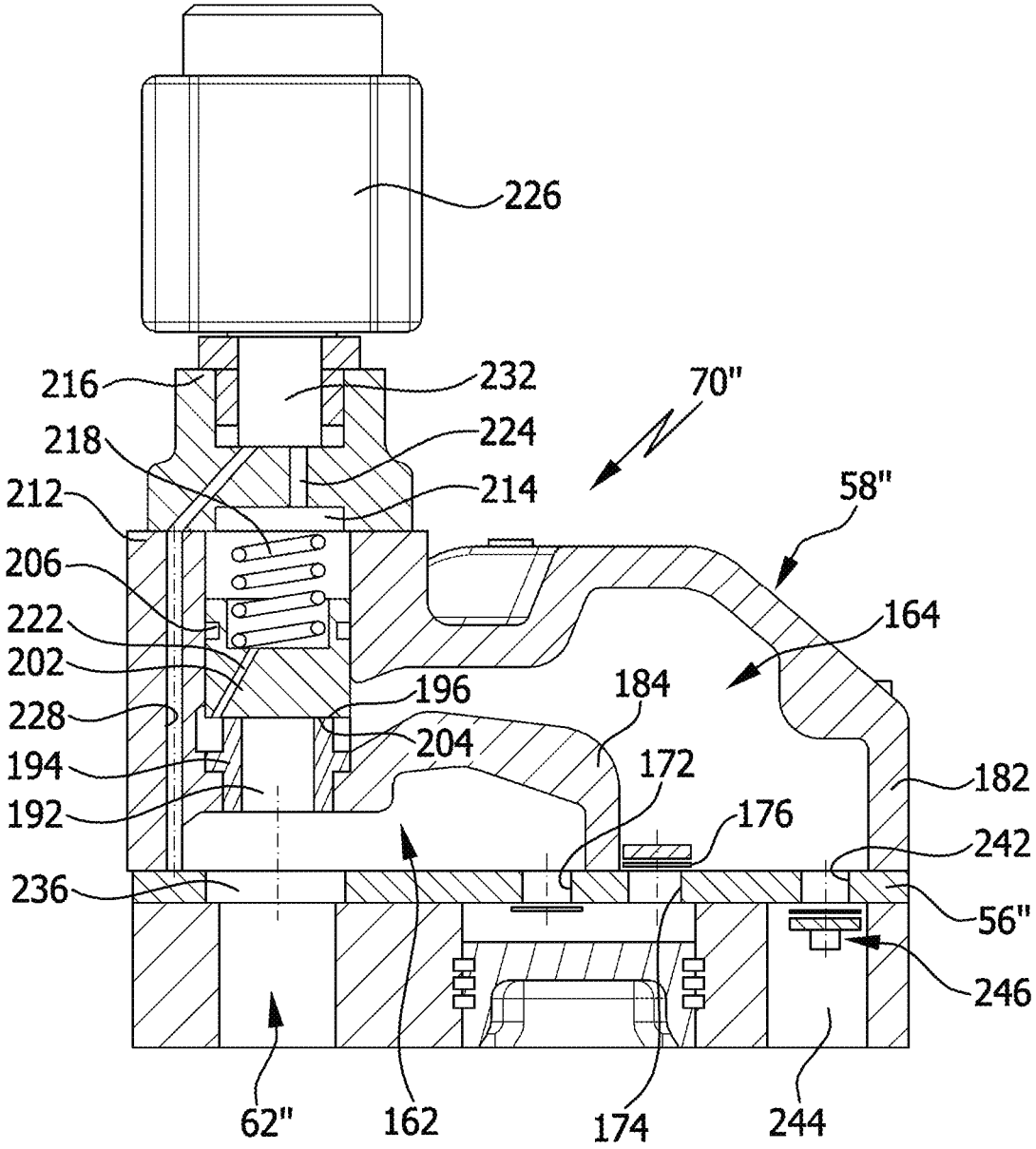
FIG. 16 shows a section similar to FIG. 15, with the connection channel between the outlet chamber and the inlet chamber closed.

In each of the cylinder heads 42"*a* and 42"*b* there is arranged, as illustrated in FIGS. 15 and 16, respectively an inlet chamber 162 and an outlet chamber 164, which are associated with the two cylinder units 44" of the respective cylinder bank 42".

In particular, the inlet chamber 162 lies above inlet openings 172 of the cylinder units 44" of the cylinder bank 42".

Further, the outlet chamber 164 lies above outlet openings 174 of the cylinder units 44", wherein the outlet openings 174 are arranged in the valve plate 56" and provided with outlet valves 176 seated on the valve plate 56", wherein these are in particular directly adjoined by the outlet chamber 164.

As illustrated in FIGS. 15 and 16, each cylinder head 42" comprises an outer body 182 which embraces the respective valve plate 56" and encloses the inlet chamber 162 and the outlet chamber 164, which for their part are separated from one another by a separating body 184 that runs within the outer body 182, wherein the separating body 184 rises from the respective valve body 56" and extends over and embraces the inlet chamber 162.

In this way, in the region of the valve plate 56" the outlet chamber 164 lies laterally next to the inlet chamber 162, but, at least in certain regions, extends above the inlet chamber 162 between the outer body 182 and the separating body 184.

For the purpose of operating condition control of the performance—that is to say, for operating condition control of the compressor conveying performance—of the refrigerant compressor 12", there is associated with each cylinder head 58" the mechanical performance control unit 70", which is actively controlled by the operating condition controller 130 and by means of which a connection channel 192 between the outlet chamber 164 and the inlet chamber 162 can be closed off or opened, wherein the cylinder units 44" that are associated with the cylinder head 58" compress refrigerant at full performance when the connection channel 192 is closed (FIG. 16), and, when the connection channel 192 is open, do not compress any refrigerant because the refrigerant flows from the outlet chamber 164 back into the inlet chamber 162.

In this arrangement, the connection channel 192 runs through an insert part 194 that is inserted into the separating body 184 and forms a gasket seat 196 which faces the outlet chamber 164 and adjoins a part of the outlet chamber 164 that surrounds and adjoins the gasket seat 196.

Further, the gasket seat 196 faces a shut-off piston 202 which is configured to be set, for example by means of a metal gasket region 204, on the gasket seat 196 in order to shut off the connection channel 192 with a tight seal, and which is configured to be raised far enough away from the gasket seat 196 for the gasket region 204 to be at a spacing from the gasket seat 196 and thus for refrigerant to be able to flow over from the outlet chamber 162 into the inlet chamber 164.

Preferably in this case, the shut-off piston 202 is guided, coaxially in relation to the insert part 194 having the gasket seat 196, and sealed off with the aid of a piston ring 206, in a guide bore 208 formed by a guide sleeve body 212 of the cylinder head 58" that is integrally formed on the outer body 182.

Preferably, the shut-off piston 202 itself, or at least the gasket region 204, is made from a metal, for example a non-ferrous metal, that has a lower hardness than the metal of the gasket seat 196, which is made for example from steel, in particular tempered steel.

In order to enable a rapid movement of the shut-off piston 202, in particular a stroke length of the shut-off piston 202 between a shut-off position and an open position lies in the range between a quarter and half of an average diameter of the connection channel 192.

Here, the shut-off piston 202 is adjacent to a pressure chamber 214, which is arranged on a side of the shut-off piston 202 remote from the gasket region 204 and is closed off on an opposite side to the shut-off piston 202 by a terminating body 216.

In particular, the volume of the pressure chamber 216 is so small that, in the open position of the shut-off piston, it is less than a third, preferably less than a quarter, more preferably less than a fifth, advantageously less than a sixth and more advantageously less than an eighth of the maximum volume of the pressure chamber 216 in the shut-off position of the shut-off piston 202.

Further, arranged in the pressure chamber 216 there is also a pressure spring 218, which is supported at one end against the terminating body 216 and at the other urges the shut-off piston 202 in the direction of its shut-off position, seated on the gasket seat 196.

Depending on the pressurisation of the pressure chamber 216, the shut-off piston 202 is movable into its open position, illustrated in FIG. 15, or into its shut-off position, illustrated in FIG. 16.

For this purpose, a throttle channel 222 passes through the shut-off piston 202, extending from the pressure chamber 214, through the shut-off piston 202, as far as an opening orifice that is arranged radially outside the gasket region on a side facing the gasket seat 196, but because the opening orifice lies radially outside the gasket region 204 the throttle channel 222 allows refrigerant which is pressurised in the outlet chamber 164 and flows around the gasket seat 196 to enter when the shut-off piston 202 is in the shut-off position, and supplies this refrigerant to the pressure chamber 214 in throttled manner.

Moreover, leading into the pressure chamber 214, for example through the terminating body 216, is a relief channel 224, which is configured to be connected to a pressure relief channel 228 by a solenoid valve designated 226 as a whole, wherein the pressure relief channel 228 is in communication with the inlet chamber 162.

For example, the solenoid valve 226 is configured such that it has a valve body 232 by means of which the connection between the pressure relief channel 228 and the relief channel 224 can be made or interrupted.

When the connection is made between the relief channel 224 and the pressure relief channel 228, suction pressure dominates in the pressure chamber 214, while the shut-off piston 202 is urged on its side facing the outlet chamber 164 by the pressure in the outlet chamber 164, and is thus moved into its open position.

However, when the connection between the pressure relief channel 228 and the relief channel 224 is interrupted by the valve body 232, the pressure spring 218 presses the shut-off piston 202 onto the gasket seat 196, and in addition high pressure flows through the throttle channel 222 and into the pressure chamber 214, with the result that high pressure builds up in the pressure chamber 214 and, in addition to the action of the pressure spring 218, presses the shut-off piston 202 onto the gasket seat 196 by means of the gasket element 204.

In particular, the shut-off piston 202 is configured such that it extends radially beyond the gasket seat 196, with the result that, even when the shut-off piston 202 is in the shut-off position, the piston face which is radially outside the gasket seat 196 and urged by high pressure causes the shut-off piston 202 to move, in opposition to the force of the pressure spring 218, into the open position illustrated in FIG. 15 provided that the valve body 232 of the solenoid valve 226 makes the connection between the relief channel 224 and the pressure relief channel 228, which causes a suction pressure to be established in the pressure chamber 214.

Refrigerant that is under suction pressure is supplied by way of a supply channel 62", which is formed in the compressor housing 40" and leads to an inlet opening leading to the valve plate 56", wherein refrigerant under suction pressure flows through the inlet opening to a passage opening 236 in the valve plate 56", through which it passes into the inlet chamber 162.

Moreover, as illustrated in FIGS. 15 and 16, the outlet chamber 164 leads to an outlet opening 242 in the valve plate 56", through which the refrigerant that is pressurised in the outlet chamber 164 passes into an outlet channel 244 provided in the compressor housing, and can flow to the high-pressure connector 16".

In particular, there is associated with the outlet opening 244 in the valve plate 56' a nonreturn valve 246 that is held against the valve plate 56' and ensures that, if the shut-off piston 202 is in the open position and hence there is an overflow of refrigerant out of the outlet chamber 164 and into the inlet chamber 162, the pressure in the outlet channel 244 does not fall but is maintained by the self-closing nonreturn valve 246.

The third exemplary embodiment of the refrigerant compressor 12" is configured to operate in the same way as the first exemplary embodiment, so in respect of its operation in operating modes B1, B2 and B2' reference may be made to the statements relating to the first exemplary embodiment in their entirety.

The invention claimed is:

1. A refrigerant compressor for refrigeration systems, comprising an electric motor, at least two cylinder banks, each of which has at least one cylinder unit having in each case at least one cylinder housing and at least one reciprocating-movement piston driven by the electric motor, and a cylinder head that is associated with each cylinder bank and has an inlet chamber, through which an inlet stream flows, and an outlet chamber, through which an outlet stream flows, and a mechanical performance control unit for activating and deactivating at least one of the cylinder banks in order to activate or deactivate its refrigerant output, wherein, for the purpose of operation in a primary partial performance condition, the refrigerant compressor is operable in at least two different operating modes, of which each provides an activation or deactivation of the cylinder banks that is different from another of the at least two different operating modes, wherein associated with the refrigerant compressor is a frequency converter for controlling the speed of the electric motor, wherein associated with the refrigerant compressor is an operating condition controller that, in accordance with a performance request signal supplied to it for operation of the refrigerant compressor in the primary partial performance condition corresponding to this performance request signal, operates the refrigerant compressor in the operating mode that is selected from the at least two different operating modes and at a speed of the electric motor adapted to the selected operating mode, for the purpose of achieving the primary partial performance condition;

wherein, in order to determine the quality grade or COP value of the at least two different operating modes, partial performance conditions, including the primary partial performance condition, to be achieved are divided into partial performance conditions that are above a boundary value and those below a boundary value, and wherein, in the case of the partial performance conditions above the boundary value in any of the at least two different operating modes that requires a higher speed of the electric motor than other operating modes, the assumption is made of a high quality grade or COP value or a low electrical power consumption, and thus these operating modes are selected, and in the case of the partial performance conditions below the boundary value in any of the at least two different operating modes that require a lower speed of the electric motor than the other operating modes, the assumption is made of a high quality grade or COP value or a low electrical power consumption and thus these operating modes are selected.

2. The refrigerant compressor according to claim 1, wherein the operating condition controller operates the refrigerant compressor in a first operating mode of the at least two different operating modes, with activation of all the cylinder banks and with adaptation of the speed of the electric motor to the first operating mode.

3. The refrigerant compressor according to claim 1, wherein the operating condition controller operates the refrigerant compressor in at least one further operating mode of the at least two different operating modes, with deactivation of at least one of the cylinder banks and with activation of at least one of the cylinder banks and with adaptation of the speed of the electric motor to the at least one further operating mode.

4. The refrigerant compressor according to claim 1, wherein, in the case of partial performance conditions, including the primary partial performance condition, that are achievable by a plurality of the at least two different operating modes, the operating condition controller selects the one of the plurality of the at least two different operating modes that results in the highest quality grade or Coefficient of Performance (COP) value or the lowest electrical power consumption of the electric motor in the partial performance condition.

5. The refrigerant compressor according to claim 4, wherein the operating condition controller determines, for the at least two different operating modes that are, in each case, possible for achieving the partial performance condition, the quality grade or the COP value or the electrical power consumption of the electric motor, and selects the operating mode by comparing the determined quality grades or COP values or electrical power consumption.

6. The refrigerant compressor according to claim 4, wherein the operating condition controller has stored data for the purpose of determining the quality grade or COP value or electrical power consumption for each of the at least two different operating modes.

7. The refrigerant compressor according to claim 4, wherein the quality grade or COP value or electrical power consumption is determined by the operating condition controller by the detection of at least one of a suction pressure and a high pressure at the refrigerant compressor.

8. The refrigerant compressor according to claim 4, wherein the operating condition controller makes use of at least one of a refrigerant, the partial performance condition, the electrical power consumption and the speed of the electric motor in order to determine the quality grade or COP value.

9. The refrigerant compressor according claim 1, wherein, in the case that one of the at least two different operating modes is a first type of operating mode, the operating condition controller permanently maintains the first type of operating mode with a deactivation and activation of the cylinder banks in order to achieve the partial performance condition that is required by the performance request signal.

10. The refrigerant compressor according to claim 1, wherein, in case that the at least two different operating modes is a second type of operating mode, the operating condition controller operates the refrigerant compressor by clocked deactivation and activation of at least one of the at least two cylinder banks at defined switching intervals, wherein, in this operating mode, the proportion of time for which at least one of the cylinder banks is deactivated and activated at the switching intervals is constant when the partial performance condition that is required by the performance request signal is achieved.

11. The refrigerant compressor according to claim 1, wherein activation and deactivation of each cylinder bank is performed with the aid of the mechanical performance control unit that is controlled by the operating condition controller.

12. The refrigerant compressor according to claim 11, wherein the mechanical performance control unit is associated with a cylinder head of the cylinder bank.

13. The refrigerant compressor according to claim 11, wherein the mechanical performance control unit controls an inlet stream into the inlet chamber of the cylinder head for the purpose of activating or deactivating the respective cylinder bank.

14. The refrigerant compressor according to claim 1, wherein the performance control unit connects the outlet chamber to the inlet chamber in the cylinder head for the purpose of activating or deactivating the respective cylinder bank.

15. The refrigerant compressor according to claim 1, wherein the operating condition controller is an operating condition controller that is separate from the frequency converter.

16. The refrigerant compressor according to claim 1, wherein the operating condition controller is arranged in a housing that receives the frequency converter.

17. The refrigerant compressor according to claim 1, wherein the cylinder banks of the refrigerant compressor work in a parallel operation.

18. The refrigerant compressor according to claim 1, wherein the refrigerant compressor has at least two cylinder units per cylinder bank.

19. The refrigerant compressor according to claim 1, wherein the refrigerant compressor has more than two cylinder banks.

20. A refrigeration system, comprising a refrigerant compressor, a heat exchanger on the high-pressure side, an expansion member, and a heat exchanger on the low-pressure side, wherein the refrigerant compressor takes a form according to claim 1.

21. The refrigeration system according to claim 20, wherein the refrigeration system has a system controller that generates the performance request signal.

22. The refrigeration system according to claim 21, wherein the operating condition controller is arranged in a housing of the system controller.

23. The refrigerant compressor according to claim 4, wherein the operating condition controller makes use of at least one of a refrigerant, the partial performance condition, and the speed of the electric motor in order to determine the quality grade, or COP value, or power consumption.

* * * * *